US010228630B2

(12) United States Patent
Mizuguchi et al.

(10) Patent No.: US 10,228,630 B2
(45) Date of Patent: Mar. 12, 2019

(54) TONER AND METHOD OF PRODUCING TONER

(71) Applicant: CANON KABUSHIKI KAISHA, Tokyo (JP)

(72) Inventors: Takuya Mizuguchi, Suntou-gun (JP); Kazuo Terauchi, Numazu (JP); Yojiro Hotta, Mishima (JP); Takeshi Naka, Suntou-gun (JP); Motohide Shiozawa, Mishima (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/697,742

(22) Filed: Sep. 7, 2017

(65) Prior Publication Data

US 2018/0074425 A1 Mar. 15, 2018

(30) Foreign Application Priority Data

Sep. 13, 2016 (JP) ..... 2016-178186

(51) Int. Cl.
*G03G 9/097* (2006.01)
*G03G 9/08* (2006.01)

(52) U.S. Cl.
CPC ..... *G03G 9/09716* (2013.01); *G03G 9/0827* (2013.01); *G03G 9/097* (2013.01); *G03G 9/09725* (2013.01); *G03G 9/09775* (2013.01); *G03G 9/09783* (2013.01); *G03G 9/09791* (2013.01); *G03G 9/0808* (2013.01)

(58) Field of Classification Search
CPC ..... G03G 9/09716; G03G 9/09725; G03G 9/09783; G03G 9/09791; G03G 9/0827
See application file for complete search history.

(56) References Cited

U.S. PATENT DOCUMENTS

| | | | |
|---|---|---|---|
| 4,561,725 | A | 12/1985 | Hotta |
| 4,569,574 | A | 2/1986 | Masaki et al. |
| 4,591,240 | A | 5/1986 | Masaki et al. |
| 4,614,407 | A | 9/1986 | Hotta et al. |
| 4,740,060 | A | 4/1988 | Komura et al. |
| 4,802,740 | A | 2/1989 | Hotta et al. |
| 5,157,509 | A | 10/1992 | Takimoto et al. |
| 5,276,542 | A | 1/1994 | Iwayama et al. |
| 5,283,564 | A | 2/1994 | Katakura et al. |
| 5,285,304 | A | 2/1994 | Hotta et al. |
| 5,321,419 | A | 6/1994 | Katakura et al. |
| 5,354,637 | A | 10/1994 | Shimamura et al. |
| 5,406,357 | A | 4/1995 | Nakahara et al. |
| 5,406,397 | A | 4/1995 | Kodera et al. |
| 5,415,967 | A | 5/1995 | Sakashita et al. |
| 5,436,701 | A | 7/1995 | Shimojo et al. |
| 5,447,813 | A | 9/1995 | Hagiwara et al. |
| 5,452,114 | A | 9/1995 | Hotta et al. |
| 5,467,209 | A | 11/1995 | Hotta et al. |
| 5,481,381 | A | 1/1996 | Fujimoto |
| 5,540,809 | A | 7/1996 | Ida et al. |
| 5,541,752 | A | 7/1996 | Taniguchi et al. |
| 5,547,796 | A | 8/1996 | Kohtaki et al. |
| 5,657,103 | A | 7/1997 | Foster |
| 5,659,840 | A | 8/1997 | Miyamoto et al. |
| 5,669,036 | A | 9/1997 | Hotta et al. |
| 5,675,354 | A | 10/1997 | Katakura et al. |
| 5,716,746 | A | 2/1998 | Mikuriya et al. |
| 5,732,314 | A | 3/1998 | Tsukida et al. |
| 5,786,879 | A | 7/1998 | Kodera et al. |
| 5,835,248 | A | 11/1998 | Hanyu et al. |
| 5,850,245 | A | 12/1998 | Goto et al. |
| 5,917,529 | A | 7/1999 | Hotta et al. |
| 5,920,757 | A | 7/1999 | Izawa et al. |
| 5,968,701 | A | 10/1999 | Onuma et al. |
| 6,020,102 | A | 2/2000 | Fujimoto et al. |
| 6,026,268 | A | 2/2000 | Shiozawa et al. |
| 6,049,681 | A | 4/2000 | Shiozawa et al. |
| 6,075,228 | A | 6/2000 | Okama et al. |
| 6,108,500 | A | 8/2000 | Ohkama et al. |
| 6,120,961 | A | 9/2000 | Tanikawa et al. |

(Continued)

FOREIGN PATENT DOCUMENTS

| | | | |
|---|---|---|---|
| JP | 2002148846 | A * | 5/2002 |
| JP | 2005121867 | A * | 5/2005 |

(Continued)

OTHER PUBLICATIONS

English language machine translation of JP-4225203-B2 (Year: 2009).*
English language machine translation of JP-2002148846-A (Year: 2002).*
English language machine translation of JP 2005-121867 (May 2005).*
Ferreira, et al., Image J User Guide IJ 1.46r (https://imagej.nih.gov/ij/docs/guide/146.html#Noteworthy).

(Continued)

*Primary Examiner* — Christopher D Rodee
(74) *Attorney, Agent, or Firm* — Venable LLP

(57) ABSTRACT

A toner comprising an external additive A, and a toner particle containing a binder resin and a colorant, wherein the external additive A: i) is an external additive that has a charge control agent on the surface thereof; ii) has a wall friction angle θ calculated from the following formula (1) of not more than 25.0°

$$\theta=\tau/5.0 \qquad \text{formula (1);}$$

iii) has a number-average particle diameter (D1) of primary particles of at least 70 nm and not more than 500 nm; and iv) has a solidity as given by the following formula (2) of at least 0.40 and not more than 0.90 solidity=area of external additive *A*/area of region encompassed by envelope for external additive *A* formula (2).

12 Claims, 4 Drawing Sheets

(56) References Cited

U.S. PATENT DOCUMENTS

| | | | | |
|---|---|---|---|---|
| 6,131,010 | A | 10/2000 | Goto et al. | |
| 6,156,471 | A | 12/2000 | Kobori et al. | |
| 6,187,496 | B1 | 2/2001 | Tanikawa et al. | |
| 6,203,959 | B1 | 3/2001 | Tanikawa et al. | |
| 6,235,441 | B1 | 5/2001 | Tanikawa et al. | |
| 6,253,038 | B1 | 6/2001 | Ito et al. | |
| 6,342,328 | B1 * | 1/2002 | Takasaki | G03G 9/08726 430/108.22 |
| 6,379,001 | B1 | 4/2002 | Tomida et al. | |
| 6,421,508 | B2 | 7/2002 | Inoue et al. | |
| 6,466,246 | B2 | 10/2002 | Fujimoto | |
| 6,495,303 | B1 | 12/2002 | Kanda et al. | |
| 6,528,222 | B2 | 3/2003 | Kohtaki et al. | |
| 6,537,715 | B2 | 3/2003 | Mizoo et al. | |
| 6,586,147 | B2 | 7/2003 | Iida et al. | |
| 6,586,151 | B1 | 7/2003 | Naka et al. | |
| 6,630,277 | B2 | 10/2003 | Naka et al. | |
| 6,652,086 | B1 | 11/2003 | Tomida et al. | |
| 6,653,036 | B1 | 11/2003 | Tanikawa et al. | |
| 6,670,087 | B2 | 12/2003 | Fujikawa et al. | |
| 6,751,424 | B2 | 6/2004 | Komatsu et al. | |
| 6,808,852 | B2 | 10/2004 | Hotta et al. | |
| 6,927,883 | B1 | 8/2005 | Fujimoto | |
| 6,929,894 | B2 | 8/2005 | Sugahara et al. | |
| 7,057,632 | B2 | 6/2006 | Yamawaki et al. | |
| 7,115,349 | B2 | 10/2006 | Iida et al. | |
| 7,138,213 | B2 | 11/2006 | Itakura et al. | |
| 7,144,668 | B2 | 12/2006 | Baba et al. | |
| 7,147,980 | B2 | 12/2006 | Itakura et al. | |
| 7,147,981 | B2 | 12/2006 | Fujikawa et al. | |
| 7,162,194 | B2 | 1/2007 | Hotta et al. | |
| 7,206,541 | B2 | 4/2007 | Fukita et al. | |
| 7,244,539 | B2 | 7/2007 | Baba et al. | |
| 7,455,947 | B2 | 11/2008 | Ida et al. | |
| 7,504,605 | B2 | 3/2009 | Nanataki et al. | |
| 7,506,830 | B2 | 3/2009 | Naka et al. | |
| 7,537,877 | B2 | 5/2009 | Yoshiba et al. | |
| 7,593,677 | B2 | 9/2009 | Shiozawa | |
| 7,611,813 | B2 | 11/2009 | Ida et al. | |
| 7,629,100 | B2 | 12/2009 | Okamoto et al. | |
| 7,715,775 | B2 | 3/2010 | Shiozawa | |
| 7,700,254 | B2 | 4/2010 | Moribe et al. | |
| 7,740,998 | B2 | 6/2010 | Yamazaki et al. | |
| 7,767,370 | B2 | 8/2010 | Ishigami et al. | |
| 7,816,063 | B2 | 10/2010 | Hashimoto et al. | |
| 7,855,042 | B2 | 12/2010 | Kobori et al. | |
| 7,897,316 | B2 | 3/2011 | Yamazaki et al. | |
| 7,912,415 | B2 | 3/2011 | Shiozawa | |
| 8,036,584 | B2 | 10/2011 | Shiozawa et al. | |
| 8,057,977 | B2 | 11/2011 | Moribe et al. | |
| 8,142,972 | B2 | 3/2012 | Hotta et al. | |
| 8,203,746 | B2 | 6/2012 | Shiozawa | |
| 8,218,990 | B2 | 7/2012 | Toyohara et al. | |
| 8,293,447 | B2 | 10/2012 | Yamazaki et al. | |
| 8,323,726 | B2 | 12/2012 | Naka et al. | |
| 8,391,733 | B2 | 3/2013 | Shiozawa | |
| 8,428,478 | B2 | 4/2013 | Shiozawa | |
| 8,501,377 | B2 | 8/2013 | Takahashi et al. | |
| 8,507,170 | B2 | 8/2013 | Takahashi et al. | |
| 8,512,925 | B2 | 8/2013 | Moribe et al. | |
| 8,736,900 | B2 | 5/2014 | Shiozawa | |
| 8,927,188 | B2 | 1/2015 | Naka et al. | |
| 9,046,800 | B2 | 1/2015 | Hotta et al. | |
| 9,040,216 | B2 | 5/2015 | Fukudome et al. | |
| 9,097,998 | B2 | 8/2015 | Yamazaki et al. | |
| 9,116,448 | B2 | 8/2015 | Terauchi et al. | |
| 9,128,400 | B2 | 9/2015 | Takahashi et al. | |
| 9,134,637 | B2 | 9/2015 | Hotta et al. | |
| 9,141,012 | B2 | 9/2015 | Moribe et al. | |
| 9,201,323 | B2 | 12/2015 | Nishikawa et al. | |
| 9,250,548 | B2 | 2/2016 | Nomura et al. | |
| 9,261,804 | B2 | 2/2016 | Yamazaki et al. | |
| 9,280,077 | B2 | 3/2016 | Tsunemi et al. | |
| 9,341,970 | B2 | 5/2016 | Yoshiba et al. | |
| 9,575,425 | B2 | 2/2017 | Naka et al. | |
| 9,588,450 | B2 | 3/2017 | Tsuda et al. | |
| 9,715,188 | B2 | 7/2017 | Terauchi et al. | |
| 9,772,570 | B2 | 9/2017 | Tsuda et al. | |
| 9,778,583 | B2 | 10/2017 | Terauchi et al. | |
| 2003/0219669 | A1 * | 11/2003 | Yamashita | G03G 9/0825 430/109.4 |
| 2006/0121382 | A1 * | 6/2006 | Choi | G03G 9/09708 430/108.21 |
| 2010/0173240 | A1 * | 7/2010 | Sensui | G03G 9/0827 430/108.2 |
| 2011/0089085 | A1 | 4/2011 | Tamura et al. | |
| 2012/0214097 | A1 | 8/2012 | Naka et al. | |
| 2013/0252167 | A1 | 9/2013 | Moribe et al. | |
| 2013/0309603 | A1 | 11/2013 | Takahashi et al. | |
| 2014/0004460 | A1 | 1/2014 | Yoshiba et al. | |
| 2014/0170549 | A1 * | 6/2014 | Tsunemi | G03G 9/097 430/108.1 |
| 2015/0125790 | A1 | 5/2015 | Hotta et al. | |
| 2015/0220013 | A1 | 8/2015 | Nishikawa et al. | |
| 2015/0261112 | A1 * | 9/2015 | Kobayashi | G03G 9/09328 430/108.22 |
| 2016/0091813 | A1 | 3/2016 | Yoshiba et al. | |
| 2016/0161874 | A1 | 6/2016 | Yamazaki et al. | |
| 2016/0202624 | A1 | 7/2016 | Nishikawa et al. | |
| 2017/0227864 | A1 | 8/2017 | Hotta et al. | |

FOREIGN PATENT DOCUMENTS

| | | |
|---|---|---|
| JP | 2005-202132 | 7/2005 |
| JP | 2007-065373 | 3/2007 |
| JP | 4225203 B2 * | 2/2009 |
| JP | 2011-185998 | 9/2011 |
| JP | 2012173575 A * | 9/2012 |
| JP | 2016-142760 | 8/2016 |
| WO | 2013/027397 | 2/2013 |

OTHER PUBLICATIONS

Ferreira, et al., "Analyze", https://imagej.nih.gov/ij/docs/guide/146-30.html#sub:Set-Measurements.

Ferreira, et al., "Convex area", https://imagej.nih.gov/ij/docs/guide/146-27.html#sub:Convex-Hull.

* cited by examiner

TONER AND METHOD OF PRODUCING TONER

BACKGROUND OF THE INVENTION

Field of the Invention

The present invention relates to a toner used in electrophotographic image-forming methods for the visualization of electrostatic images. The present invention also relates to a method of producing a toner.

Description of the Related Art

Higher image qualities are being required of image-forming apparatuses that use electrophotographic systems. In order to improve image quality, improvements in the transferability and fine line reproducibility are required and the development is then required of a toner that has an excellent charging capability, a sharp particle size distribution, and a spherical particle shape. In addition to improvements in image quality, there has also been strong desire in recent years for higher apparatus speeds and longer apparatus life, and a problem here is that it is increasingly difficult for the toner to have a stable charging performance.

On the other hand, an inorganic fine particle powder of metal oxide or the like is incorporated in toner in order to obtain a stable charging performance even in long-term use. Among the heretofore used external additives, external additives provided by treatment of the external additive surface with a charge control agent have been proposed in order to obtain a stable charging performance even in long-term use.

For example, it is proposed in Japanese Patent Application Laid-open No. 2007-65373 that an excellent charge rising performance and an excellent charge stability are exhibited by a toner to which a composition containing a charge control agent and a fluidizing agent has been added.

In addition, Japanese Patent Application Laid-open No. 2011-185998 proposes a toner that contains external-addition charge control particles provided by the deposition of a charge control agent on the surface of hydrophilic spherical silica fine particles obtained by a sol-gel method.

SUMMARY OF THE INVENTION

However, when a composition containing a charge control agent and a fluidizing agent is externally added to a spherical toner, as in Japanese Patent Application Laid-open No. 2007-65373, a certain effect on the charging capability of the toner does appear, but image defects originating with faulty cleaning are found to be produced. With respect to systems that clean the toner from the photosensitive drum using a cleaning blade, as a general matter cleaning becomes more difficult as the toner shape becomes more spherical. In addition to this, it is thought that the cleaning performance is reduced when the electrostatic attachment force between the photosensitive drum and toner is increased due to an improved charging performance by the toner. Thus, there is room for improvement in the cleaning performance.

Also in the case of Japanese Patent Application Laid-open No. 2011-185998, while a certain effect on the charging capability of the toner does appear, due to the external addition to spherical toner, image defects originating with faulty cleaning cannot be prevented and there is still room for improvement.

Thus, even when the charging performance of the toner is improved in order to raise the image quality, there are still numerous technical problems in order to suppress faulty cleaning, and room for improvement remains.

An object of the present invention is to provide a toner that exhibits an improved charging performance, that maintains an excellent cleaning performance, and that suppresses various image defects.

As a result of extensive investigations, the present inventors discovered that the requirements indicated above could be satisfied by having the constitution indicated below and thus achieved the present invention.

That is, the present invention relates to a toner comprising an external additive A, and a toner particle containing a binder resin and a colorant, wherein the external additive A i) has a charge control agent present on the surface thereof, ii) has a wall friction angle θ calculated from the following formula (1) of not more than 25.0°

$$\theta=\tau/5.0 \qquad \text{formula (1)}$$

where τ represents a shear stress obtained when a flat circular disk is rotated (π/36) rad at (π/10) rad/min while the flat circular disk is inserted at a perpendicular load of 5.0 kPa into a powder layer of the external additive A formed by applying a perpendicular load of 15.0 kPa, iii) has a number-average particle diameter (D1) of primary particles of at least 70 nm and not more than 500 nm, and iv) has a solidity as given by the following formula (2) of at least 0.40 and not more than 0.90

$$\text{solidity}=\text{area of external additive } A/\text{convex area of external additive } A \qquad \text{formula (2).}$$

The present invention also relates to a method of producing a toner, including: a step of obtaining an external additive A by subjecting an external additive to a surface treatment with a charge control agent; and a step of mixing the external additive A with a toner particle containing a binder resin and a colorant, wherein the external additive A has a wall friction angle θ calculated from the following formula (1) of not more than 25.0°

$$\theta=\tau/5.0 \qquad \text{formula (1)}$$

where τ represents a shear stress obtained when a flat circular disk is rotated (π/36) rad at (π/10) rad/min while the flat circular disk is inserted at a perpendicular load of 5.0 kPa into a powder layer of the external additive A formed by applying a perpendicular load of 15.0 kPa, the external additive A has a number-average particle diameter (D1) of primary particles of at least 70 nm and not more than 500 nm, and the external additive A has a solidity as given by the following formula (2) of at least 0.40 and not more than 0.90 solidity=area of external additive A/convex area of region encompassed by envelope for external additive A formula (2).

The present invention can thus provide a toner that exhibits an improved charging performance, that maintains an excellent cleaning performance, and that suppresses various image defects.

Further features of the present invention will become apparent from the following description of exemplary embodiments (with reference to the attached drawings).

DESCRIPTION OF THE EMBODIMENTS

Figure 1A:
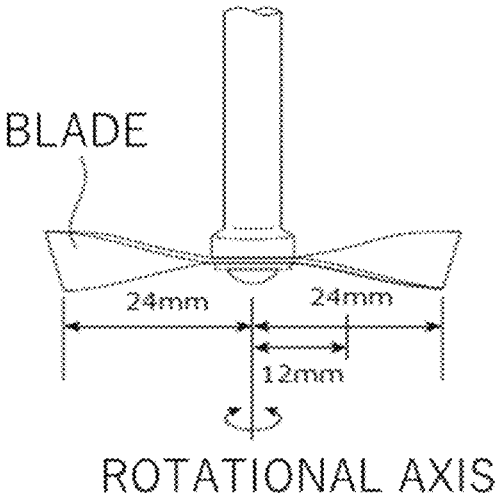
FIGS. 1A and 1B are a propeller-type blade in an apparatus for analyzing powder flowability.

Unless specifically indicated otherwise, expressions such as "at least XX and not more than YY" and "XX to YY" that show numerical value ranges refer in the present invention to numerical value ranges that include the lower limit and upper limit that are the end points.

Because a spherical toner presents little unevenness in the toner surface, there is then little variation in the state of contact between the toner and photosensitive drum and the transferability and fine line reproducibility are excellent. Moreover, there is also little variation in the manner of attachment by the external additive and due to this the flowability and charging performance are also excellent. Thus, viewed from the standpoint of improving the image quality, when evaluations have been performed on toner provided by the addition to spherical toner of an external additive having a charge control agent on the surface thereof, a certain effect on the charging capability has appeared, but it has been found that the cleaning performance declines and image defects are produced.

This is thought to be due to a reduction in the cleaning performance resulting from an increase in the electrostatic attachment force between the photosensitive drum and toner due to the improved toner charging performance. Increasing the contact pressure by the cleaning blade against the photosensitive drum is a method generally known for improving the cleaning performance, and the cleaning performance has been maintained by setting up a structure whereby toner traverse is suppressed. However, the blade edge is readily pulled in the direction of drum rotation in the case of measures that rely on simply increasing this lineal pressure. As a result, the photosensitive drum-versus-blade contact angle ends up being reduced and problems such as a decline in the cleaning performance, the appearance of blade curling, and so forth are conversely produced. As a consequence, this has necessitated, with regard to the higher speeds and longer service lives going forward, investigations into toner that would provide an excellent cleaning performance even at increased peripheral velocities for the drum and without reducing the drum-versus-blade contact angle.

As a result of carrying out investigations in order to resolve the trade-off between improving the toner charging performance—with the objective of enhancing image quality—and suppressing faulty cleaning, the present inventors discovered that this problem could be solved by using a toner to which an external additive having the aforementioned characteristic features was added.

The external additive A used in the toner of the present invention is specifically described in the following.

The external additive A is an external additive that has a charge control agent (surface-treatment agent) on the surface thereof, and the external additive A has a wall friction angle θ as calculated from formula (1) of not more than 25.0°. The wall friction angle θ is preferably not more than 23.0° because this provides a large friction-reduction effect and an excellent cleaning performance is obtained. By having the external additive A have the constitution described above, the photosensitive drum-versus-blade frictional force is reduced—without causing a reduction in toner flowability—and an excellent cleaning performance is obtained.

In addition, fogging can be suppressed because an excellent charging performance is obtained. Moreover, by having the wall friction angle be in the indicated range, there is also little frictional force when the external additive A slips through between the photosensitive drum and blade and a suppressing effect on drum scratching then also accrues. While there is no particular limitation on the lower limit for the wall friction angle θ, it is preferably at least 10.0°.

The wall friction angle is a property that indicates the frictional resistance between a flat substrate and the surface of a powder layer. A larger wall friction angle indicates a higher frictional resistance, while a smaller wall friction angle indicates a lower frictional resistance. Thus, in order to realize a friction-reduction effect when the external additive slips through between the photosensitive drum and blade, the external additive itself must be a material that has a low wall friction angle. The present inventors carried out intensive investigations in order to obtain this effect and as a result discovered that, by having the wall friction angle θ calculated with formula (1) be in the range given above, a satisfactory friction-reduction effect is realized when the external additive A slips through between the photosensitive drum and blade. When the wall friction angle θ is larger than 25.0°, the external additive A itself exhibits a large friction and a satisfactory friction-reduction effect at between the photosensitive drum and the blade cannot then be obtained and the cleaning performance declines.

An external additive having a charge control agent (surface-treatment agent) on the surface thereof must be used in order to achieve the range indicated above for the wall friction angle. In particular, coating the surface of the external additive with a charge control agent by a surface treatment is preferred. While the reason for this unclear, the following is hypothesized.

Materials that contain an atom having a large electronegativity are generally known to have a low coefficient of friction. This can be understood by considering the definition of the van der Waals force. The van der Waals force is the attractive force produced when two atoms approach each other and is caused by the fluctuation of electrons. The van der Waals force is therefore small for substances that exhibit a high electronegativity and are resistant to the occurrence of electronic fluctuations. The coefficient of friction is therefore also small.

A characteristic feature of the present invention is that a charge control agent is present at the surface of the external additive, and it is thought that the polar substituents, having a high affinity with atmospheric moisture, readily face in the surface direction as a consequence. It is thought that such a polar substituent, since it incorporates highly electronegative atoms, easily contacts the opposing substance and low friction characteristics are then exhibited.

A charge control agent known for use in toners can be used as the charge control agent (surface-treatment agent). Examples of negative-charging charge control agents are metal compounds of aromatic carboxylic acids such as salicylic acid, alkylsalicylic acid, dialkylsalicylic acid, naphthoic acid, and dicarboxylic acid; monoazo metal compounds such as metal compounds (metal salt or metal complex) of an azo dye or azo pigment; polymers having a sulfonic acid group or a carboxy group; urea compounds; and calixarene.

The positive-charging charge control agents can be exemplified by quaternary ammonium salts, polymers having a quaternary ammonium salt, guanidine compounds, nigrosine compounds, and imidazole compounds. Polymer-type charge control agents (charge control resins) are preferred in the present invention from the standpoint of ease of treatment of the external additive surface. Selection is preferably made from the group consisting of monoazo metal compounds and polymers having a sulfonic acid group or a carboxy group. In addition, the use is preferred of a selection from polymers having a sulfonic acid group and polymers having a salicylic acid-derived substructure.

The weight-average molecular weight (Mw) of the charge control resin is preferably at least 1,000 and not more than 300,000 because this enables the uniform treatment of the surface of the external additive. At least 3,000 and not more than 50,000 is more preferred.

External additive A preferably has, on the surface thereof, a compound selected from the group consisting of metal compounds of aromatic carboxylic acids, metal compounds of an azo dye or azo pigment, polymers having a sulfonic acid group or carboxy group, quaternary ammonium salts, polymers having a quaternary ammonium salt, guanidine compounds, nigrosine compounds, and imidazole compounds. This compound is more preferably a compound selected from the group consisting of monoazo metal compounds and polymers having a sulfonic acid group or carboxy group.

Polymers having a sulfonic acid group can be exemplified by resins derived from styrenesulfonic acid, 2-acrylamido-2-methylpropanesulfonic acid (AMPS), vinylsulfonic acid, methacrylsulfonic acid, maleimide derivatives, or styrene derivatives, and by maleic acid amide derivatives with formula (3) below, while resins having a substructure derived from 2-acrylamido-2-methylpropanesulfonic acid are particularly preferred. The content in the charge control resin of the substructure derived from 2-acrylamido-2-methylpropanesulfonic acid is preferably at least 0.3 mass % and not more than 20.0 mass %.

(3)

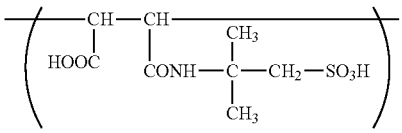

Carboxy group-containing polymers and salicylic acid group-containing polymers can be exemplified by a polymer or copolymer produced by at least one monomer selected from the group consisting of such as 3-vinylsalicylic acid, 4-vinylsalicylic acid, 5-vinylsalicylic acid, 6-vinylsalicylic acid, 3-vinyl-5-isopropylsalicylic acid, 3-vinyl-5-t-butylsalicylic acid and 4-vinyl-6-t-butylsalicylic acid, and a polymer A having the monovalent group a given by the following formula (4), with the polymer A having the monovalent group a given by formula (4) being particularly preferred.

(4)

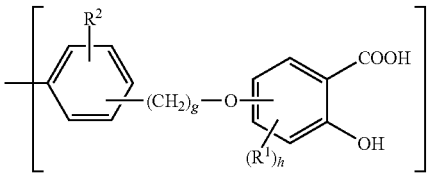

(In the formula, each $R^1$ independently represents a hydroxy group, a carboxy group, an alkyl group having at least 1 and not more than 18 carbons, or an alkoxy group having at least 1 and not more than 18 carbons; $R^2$ represents a hydrogen atom, a hydroxy group, an alkyl group having at least 1 and not more than 18 carbons, or an alkoxy group having at least 1 and not more than 18 carbons; g represents an integer that is at least 1 and not more than 3; and h represents an integer that is at least 0 and not more than 3.)

The alkyl groups encompassed by $R^1$ and $R^2$ can be exemplified by the methyl group, ethyl group, propyl group, isopropyl group, butyl group, isobutyl group, s-butyl group, and t-butyl group, while the alkoxy groups can be exemplified by the methoxy group, ethoxy group, and propoxy group.

There are no particular limitations on the main chain structure of the polymer A.

Examples here are vinyl polymers, polyester polymers, polyamide polymers, polyurethane polymers, and polyether polymers. Another example is a hybrid polymer in which two or more of these are combined. Among these, vinyl polymers are preferred based on a consideration of the adherence with the toner base particle. The content of the monovalent group a in the polymer A is preferably at least 0.3 mass % and not more than 30 mass %.

The polymer A can be synthesized, for example, using as monomer a compound having a polymerizable functional group, e.g., the vinyl group, in a substituent position on the group given by formula (4). In this case, the polymer A having the monovalent group a is given by the following formula (4-2).

(4-2)

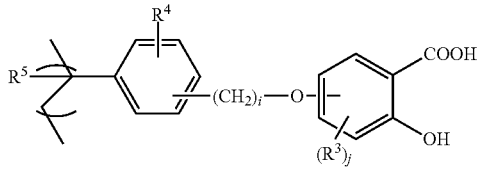

[In formula (4-2), each $R^3$ independently represents an alkyl group having at least 1 and not more than 18 (preferably at least 1 and not more than 4) carbons or an alkoxy group having at least 1 and not more than 18 (preferably at least 1 and not more than 4) carbons. $R^4$ represents a hydrogen atom, a hydroxy group, an alkyl group having at least 1 and not more than 18 (preferably at least 1 and not more than 4) carbons, or an alkoxy group having at least 1 and not more than 18 (preferably at least 1 and not more than 4) carbons. $R^5$ represents a hydrogen atom or a methyl group; i represents an integer that is at least 1 and not more than 3; and j represents an integer that is at least 0 and not more than 3.]

The charge control resin preferably has an acid value of at least 15 mg KOH/g and not more than 35 mg KOH/g. As indicated above, the friction-reduction effect in the present invention is believed to be developed through a polar substituent. Thus, an excellent friction-reduction effect can be manifested when the acid value is at least 15 mg KOH/g. In addition, when the acid value is not more than 35 mg KOH/g, increases in the amount of moisture adsorption are impeded and an inhibition of fogging is thus facilitated. The acid value can be controlled through the type of monomer used and the monomer ratio.

Method for Measuring the Wall Friction Angle

The wall friction angle is measured in the present invention using a powder flowability analyzer (FT4 Powder Rheometer, Malvern Instruments Ltd.) equipped with a rotary propeller-type blade and a rotary circular flat disk blade.

Figure 1B:
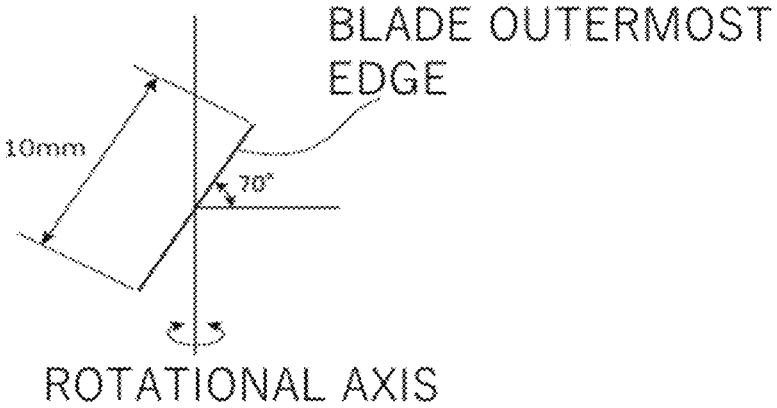

The measurement is specifically carried out using the following procedure. A blade with a diameter of 48.0 mm provided for use in measurement with the FT4 is used in the procedure for the propeller-type blade (refer to FIGS. 1A and 1B: the rotational axis is present in the perpendicular direction in the center of a 48 mm×10 mm blade member, and the blade member is smoothly twisted counterclockwise so that both outermost edges (the locations 24 mm from the rotational axis) are at 70° and the locations at 12 mm from the rotational axis are at 35°. The material is SUS. This is also abbreviated as "blade" in the following.).

Figure 2:
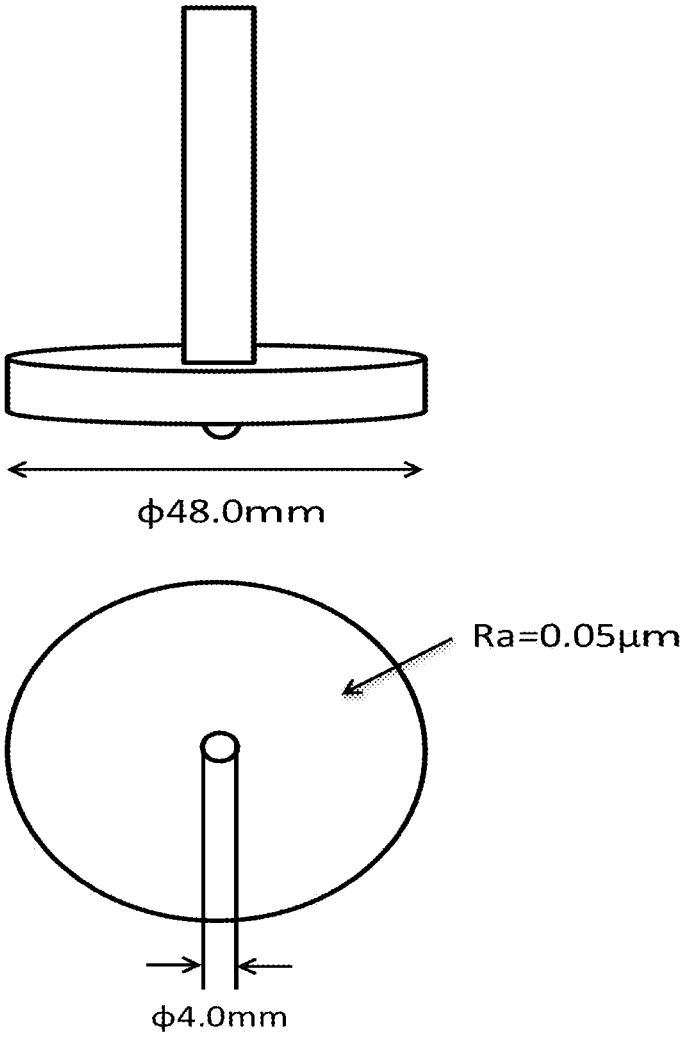
FIG. 2 is a flat circular disk for measurement of the wall friction angle.

Measurement of the wall friction angle is carried out using a circular flat disk blade (refer to FIG. 2: diameter=48.0 mm, thickness=1.5 mm. The material is SUS. This is also abbreviated as "disk" in the following.). For use, a laminate sheet having a NANOS layer (layer provided by the application of a fluoropolymer as a nanoscale thin film) as its surface side is glued to the disk surface (surface in contact with the external additive A). This laminate sheet is a sheet in which (1) a pressure-sensitive adhesive layer, (2) a PET film, (3) an antireflective layer, and (4) the NANOS layer are laminated in the indicated sequence. The ten-point average roughness Rz of the surface of this laminate sheet is approximately 0.060 μm (measured by Surfcorder SE3500 surface roughness measurement instrument, Kosaka Laboratory Ltd.). This laminate sheet can be acquired from Katsurayama Technology Inc. The purpose of the application of this sheet is to facilitate measurement of the friction between the powder layer and flat disk by providing the circular flat disk with a material that easily slides on the consolidated powder layer surface.

The powder layer is provided by introducing the external additive, after holding for at least 3 days in a 23° C./60% humidity environment, into a cylindrical split vessel (height from the vessel bottom to the split position=43 mm. Material=glass. Also abbreviated in the following as the "vessel".) having a diameter of 50 mm and a volume of 85 mL that is an FT4 measurement accessory; the external additive is introduced to the top of this vessel.

1. Conditioning Step (a) Insertion is performed from the surface of the powder layer to a position 10 mm from the bottom of the powder layer using a rotational direction that is clockwise with respect to the powder layer surface (direction whereby the powder layer is loosened by blade rotation), using a peripheral velocity at the outermost edge of the blade of 60 mm/sec for the blade rotation speed, and using, for the insertion velocity in the perpendicular direction into the powder layer, a speed that provides 5 deg for the angle formed between the surface of the powder layer and the trajectory traced by the outermost edge of the blade during motion (this is also referred to below as the "formed angle"). This is followed by the execution of a step in which insertion is carried out to a position 1 mm from the bottom of the powder layer using a clockwise rotational direction with respect to the powder layer surface, a blade rotation speed of 40 mm/sec, and a speed that provides a formed angle of 2 deg for the insertion velocity in the perpendicular direction into the powder layer. This is followed by withdrawal by movement to a position 80 mm from the bottom of the powder layer using a counterclockwise rotational direction with respect to the powder layer surface, a blade rotation speed of 60 mm/sec, and a withdrawal speed from the powder layer that provides a formed angle of 5 deg. Once the withdrawal is complete, the powder sticking to the blade is knocked off by small rotations of the blade back and forth between clockwise and counterclockwise.

2. Powder Layer Consolidation Step

To compress the powder layer, a compression test piston (diameter=48.0 mm, height=20 mm, with lower mesh) is used instead of the propeller-type blade described above, and insertion into the powder layer is performed at 0.5 mm/sec from a height of 80 mm from the bottom of the powder layer. After the application of a load of 0.55 kPa to the surface of the powder layer at this speed, the blade insertion speed is changed to 0.04 mm/sec and a load of 15.0 kPa is applied and consolidation is carried out in this state for 60 seconds.

3. Splitting Step

The powder layer is leveled at the splitting position of the vessel provided as described above as an accessory for measurement with the FT4, and the powder in the upper powder layer is removed to form a powder layer with a height of 43 mm from the bottom of the vessel to the split position.

4. Measurement Step (1) The compression test piston is exchanged for a disk blade, which is the blade for measurement of the wall friction, and consolidation is carried out again by the application of a load of 15.0 kPa at 0.08 mm/sec.

(2) Then, while maintaining the consolidation, a preliminary shear is applied to the powder layer surface by rotating ($\pi/3$) rad clockwise with respect to the powder layer surface at a speed of ($\pi/10$) rad/min.

(3) The shear load is then removed and only a perpendicular load of 5.0 kPa is applied and a standby state is maintained for 25 seconds.

(4) After the standby, the shear stress $\tau$ is measured, which is determined from the rotational torque when the disk blade is rotated ($\pi/36$) rad at ($\pi/10$) rad/min in the clockwise rotational direction with respect to the powder layer surface.

(5) The wall friction angle $\theta$ is determined from the following formula using the obtained value of the shear stress $\tau$.

$$\theta=\tau/5.0 \quad (1)$$

Case of Measurement from the Toner

The wall friction angle $\theta$, the number-average particle diameter (D1), infra, and so forth can be determined by separating the external additive A from the toner using the following method. First, the toner is ultrasonically dispersed in deionized water to which several drops of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.) have been added, thereby transferring the external additive from the toner surface to the deionized water. The deionized water is thereafter separated from the toner particles by centrifugal separation. Utilizing differences in particle shape and/or specific gravity, the external additive dispersed in the deionized water can then be separated by additional centrifugal separation to give external additive A.

The number-average particle diameter (D1) of primary particles of the external additive A is at least 70 nm and not more than 500 nm.

By having the number-average particle diameter (D1) of primary particles be in the indicated range, a satisfactory friction-reduction effect is then exhibited when the external additive A slips through between the photosensitive drum and blade. When the number-average particle diameter (D1)

is smaller than 70 nm, a satisfactory clearance between the photosensitive drum and blade is not possible when the external additive A slips past the cleaning nip region and due to this a friction-reduction effect cannot be exhibited. When the number-average particle diameter (D1) is larger than 500 nm, the external additive A cannot smoothly slip through between the photosensitive drum and blade and a friction-reduction effect cannot be exhibited. In addition, when the external additive A does slip through, the gap between the photosensitive drum and blade is too large and the appearance of slip through by the toner is then also a concern. The number-average particle diameter (D1) is preferably at least 70 nm and not more than 400 nm.

Method for Measuring the Number-Average Particle Diameter (D1) of Primary Particles The number-average particle diameter (D1) of primary particles of the external additive is measured using a "JEM2800" (JEOL Ltd.) transmission electron microscope (TEM).

The measurement sample is first prepared. 1 mL of isopropanol is added to approximately 5 mg of the external additive and dispersion is carried out for 5 minutes using an ultrasound disperser (ultrasound cleaner). 1 drop of this dispersion is then dripped onto a support film-bearing micro-grid (150 mesh) for TEM, and the measurement sample is prepared by drying.

Using the condition of an acceleration voltage of 200 kV, image acquisition is performed with the transmission electron microscope (TEM) at a magnification (for example, 200 k-fold to 1 M-fold) that enables the length of the external additive in the visual field to be satisfactorily measured; the diameter (maximum diameter) of 100 randomly selected external additive primary particles is measured; and the number-average particle diameter is determined. Measurement of the primary particle diameter may be done manually or a measurement tool may be used.

The external additive A must have a shape for which the average value of the solidity as given by the following formula (2) is at least 0.40 and not more than 0.90. Suppression of drum scratching is readily manifested by controlling this solidity to at least 0.40 and not more than 0.85, which is thus preferred.

$$\text{solidity} = \text{area of external additive } A / \text{convex area of external additive } A \quad \text{formula (2).}$$

In a blade-based cleaning apparatus, slip through by the toner is prevented by the application of a strong lineal pressure between the photosensitive drum and blade, and a strong pressure is thus also applied to the external additive, which naturally slips through. When, at this time, there are few points of contact between the external additive and the surface of the photosensitive drum, the lineal pressure of the blade is concentrated at one point on the photosensitive drum surface and faulty cleaning induced by photosensitive drum scratching then ends up being produced. The present inventors therefore carried out investigations focused on the shape of the external additive and found that it is essential for the solidity of the external additive to be in the range specified above.

The solidity is an index given by formula (2), and it is the value provided by dividing the area of the external additive by the convex area of the external additive. This convex area is the area of the region encompassed by the envelope produced based on the contour of the external additive of interest. The solidity is a quantity that takes on a value between 0 and 1, with smaller values indicating a more convoluted shape with more depressed portions. Thus, when the solidity value of the external additive used has a smaller value, there are then more contact points between the external additive and the surface of the photosensitive drum and the pressure from the blade can be dispersed over the surface of the photosensitive drum. That is, it was found that faulty cleaning induced by drum scratching can be suppressed by controlling the shape of the external additive A. When the average value of the solidity of the external additive A is less than 0.40, too many depressed portions are then present and as a result it is difficult to produce rolling by the external additive A between the photosensitive drum and blade and the friction-reduction effect becomes inadequate. When the average value of the solidity of the external additive A is larger than 0.90, there are then few depressed portions and thus few points of contact between the external additive A and the surface of the photosensitive drum and due to this faulty cleaning induced by drum scratching ends up being produced.

This effect could not be satisfactorily described using the aspect ratio, which has heretofore been used as an index of external additive shape. This is because the aspect ratio is an index that simply shows the degree of elongation of a shape and an elongated shape is unrelated to increasing the points of contact with the drum surface.

In order for such an external additive A to exhibit a lubricating effect, the external additive A must transfer from the toner surface to the surface of the photosensitive drum and must be fed to between the photosensitive drum and the blade nip. With regard to a method for measuring this condition, it was found that this measurement could be performed by a procedure in which the toner is deposited on the surface of a polycarbonate thin film and the toner is then suctioned off and the surface of the polycarbonate thin film is subsequently inspected with a scanning electron microscope (SEM). The specific measurement procedure is as follows.

Polycarbonate Thin Film Attachment Measurement Method

Figure 3:
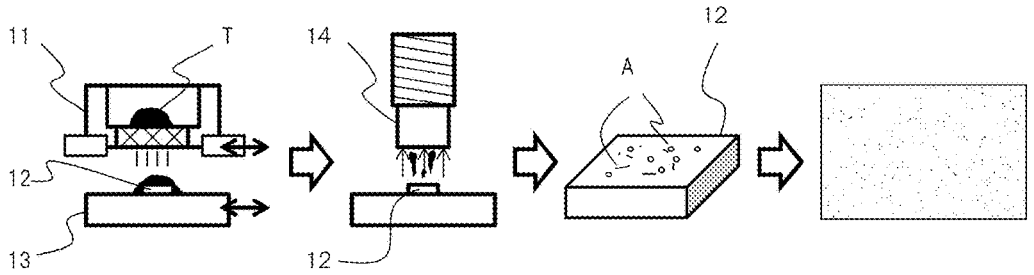
FIG. 3 is a schematic diagram that shows a method for measuring polycarbonate thin film attachment.

The individual steps in a polycarbonate thin film attachment measurement method are shown in FIG. 3. The method for disposing the toner T on a substrate 12 in FIG. 3 uses a sieve 11 having a stainless steel mesh with an aperture of 75 μm. In order for the substrate to simulate the surface layer of the photosensitive member, a coating solution for a 50-μm aluminum sheet was prepared by dissolving a polycarbonate (Iupilon Z-400, Mitsubishi Engineering-Plastics Corporation, viscosity-average molecular weight (Mv)=40,000) in toluene at 10 mass %. This coating solution was coated on the aluminum sheet using a #50 Mayer bar; drying for 10 minutes at 100° C. then produced a sheet having polycarbonate with a film thickness of 10 μm on aluminum sheet.

This sheet was held with a substrate holder 13. The substrate was a square with a side of about 3 mm. About 10 mg of the toner was introduced onto the sieve and the substrate was placed directly below the sieve at a distance of 20 mm. The sieve opening has a diameter of 10 mm so toner falling down from the sieve is efficiently deposited on the substrate.

The toner was deposited on the substrate by the application, to the frame holding the sieve, of a sawtooth-waveform oscillation having a duty ratio of 33% and an amplitude of 1 mm; the oscillation was applied for 30 seconds at 5 Hz in the in-plane direction of the sieve and corresponded to an acceleration of 5 G.

Step of Applying Shaking to the Toner-Bearing Substrate

Contact between the substrate and toner was then promoted by the application, to the substrate on which the toner had been deposited, of a sawtooth-waveform oscillation having a duty ratio of 33% and an amplitude of 1 mm; the oscillation was applied for 20 seconds at 3 Hz in the in-plane direction of the substrate and corresponded to an acceleration of 0.5 G.

Step of Removing the Toner from the Substrate

After the application of the oscillation, the toner attached to the substrate is removed by bringing the substrate into proximity to an elastomeric suction port having an inner diameter of approximately 5 mm and connected to the nozzle end of a vacuum cleaner as a suction means 14, so that the suction port becomes perpendicular to the toner-bearing side. The toner was removed while visually checking the degree of residual toner. In this embodiment, the distance between the end of the suction port and the substrate was approximately 1 mm and the suction time was approximately 3 seconds. The suction pressure at this time was measured at 6 kPa.

Step of Quantitating the Amount of Attachment of the External Additive Supplied to the Substrate Observation and image measurement with a scanning electron microscope were used to digitize the amount and shape of the external additive that remained on the substrate after toner removal. The observation sample was first prepared by sputtering Pt for 60 seconds at a current of 20 mA onto the substrate post-toner removal. In the scanning electron microscopic observation, any observation magnification can be selected that enables observation of the approximately 100 nm external additive. The observation is carried out using a Hitachi S-4800 ultrahigh resolution field-emission scanning electron microscope (Hitachi High-Technologies Corporation), and is carried out using the backscattered electron image on the S-4800.

The observation magnification depends on the particle diameter of the external additive, but, for example, if it is approximately 100 nm, then the observation can be carried out using conditions of 20,000×, an acceleration voltage of 10 kV, and a working distance of 3 mm. The observation region at 20,000× is an approximately 30 μm×20 μm region.

Figure 4:
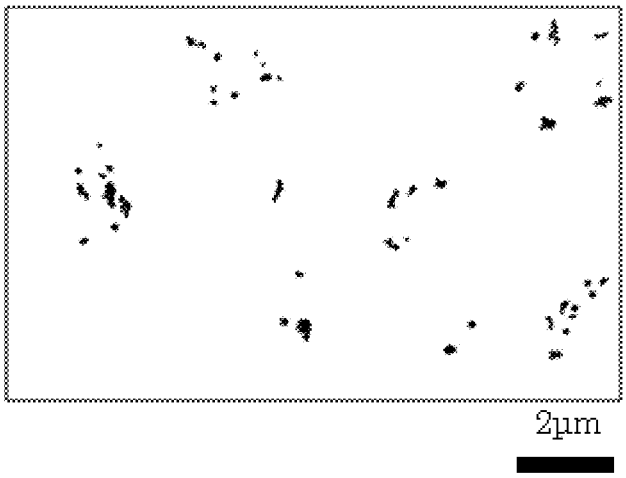
FIG. 4 is an example of a binarized image used for quantitation of external additive shape.

Since, in the image provided by the observation, the external additive is represented by high brightness and the substrate is represented by low brightness, the amount of external additive in a visual field can be quantitated via binarization. The binarization conditions can be selected as appropriate depending on the observation instrumentation and the sputtering conditions. In the present case, ImageJ image analysis software (developer: Wayne Rasband) is used for the binarization, and the background brightness distribution is subtracted with the Subtract Background menu using a rolling ball radius of 40 pixels; this is followed by binarization at a brightness threshold value of 50. An example of the resulting binarized image is given in FIG. 4.

The amount of attachment of the external additive is calculated through particle analysis, using the ImageJ image analysis software, of the resulting binarized image. The amount of attachment was calculated from the particles in the binarized image by defining the area and/or shape. Of the high-brightness external additive in the field of observation, the particle area is the value extracted by specifying, using the image analysis software, particles with a shape having a solidity of at least 0.40 and not more than 0.90 and area of at least 0.005 $\mu m^2$ and not more than 5.0 $\mu m^2$. The method for measuring the solidity is described below.

Using 100% for the area of the polycarbonate thin film in the region of observation, the external additive area ratio that the external additive area took up in the overall visual field was determined by using the particle area calculated from the particles in the binarized image with specification of the area and/or shape. This measurement was performed for 100 binarized images and the average value therefrom was used as the amount of attachment of the external additive A.

Method for Measuring the Solidity of the External Additive A

The solidity of the external additive A can be measured by a method in which the external additive A is externally added to the toner particle; the toner surface is observed with a scanning electron; and the resulting image is analyzed. Specifically, 0.3 mass parts of the external additive A is mixed for 5 minutes with 100 mass parts of the toner particle using an FM mixer (Nippon Coke & Engineering. Co., Ltd.) and a condition of 3,600 $s^{-1}$. The resulting toner surface is observed using a Hitachi S-4800 ultrahigh resolution field-emission scanning electron microscope (Hitachi High-Technologies Corporation).

With regard to the observation conditions, the magnification is adjusted as appropriate to 100,000× to 200,000× depending on the size of the external additive A. In order to carry out image processing of the external additive A, the acceleration voltage during observation is adjusted upward (for example, 10 kV), and the external additive A is indicated at high brightness and the toner particle is indicated at low brightness by observation using the backscattered electron image, which is thus preferred.

Image processing was carried out using ImageJ image analysis software (developer: Wayne Rasband): by binarizing the high brightness external additive A and the low brightness toner particle, the area of each particle of the external additive A and the area of the region encompassed by the envelope for external additive A were calculated and the average value of the solidity was measured using the following formula (2). The binarization conditions can be selected as appropriate based on the observation instrumentation and the sputtering conditions. The solidity of each particle of the external additive A can be obtained using the Solidity in the ImageJ image analysis software.

$$\text{solidity} = \text{area of external additive } A / \text{convex area of external additive } A \quad \text{formula (2).}$$

The specific measurement method is as follows. A selection is made of 100 toners that have a long diameter R (μm) that satisfies the relationship $0.9 \leq R/D4 \leq 1.1$ with respect to the weight-average diameter D4 (μm) measured using the "Coulter Counter Multisizer 3" (registered trademark, Beckman Coulter, Inc.), a particle size distribution measurement instrument as described below. A relatively flat region of the toner surface (field of interest in focus in the overall area of observation) is selected; observation is carried out of 1 field of interest per 1 toner; and 100 images are obtained.

Image Analysis

The average solidity is calculated from the obtained SEM observation images using ImageJ image analysis software (developer: Wayne Rasband). The calculation procedure is as follows.

1) Set the scale with [Analyze]–[Set Scale].

2) Set the threshold value with [Image]–[Adjust]–[Threshold].

(a value is set at which noise does not remain and the external additive, which is the measurement target, does remain)

3) Select the image region of the measured external additive with [Image]–[Crop].

4) Eliminate overlapped external additive by image editing.

5) Perform white/black image inversion with [Edit]–[Invert].

6) Check [Area], [Shape Descriptors], [Perimeter], [Fit Ellipse], and [Ferets Diameter] at [Analyze]–[Set Measurements]. Also, set [Redirect to] to [None] and [Decimal Place (0-9)] to 3.

7) Designate a particle area of at least 0.005 $\mu m^2$ at [Analyze]–[Analyze Particle] and execute.

8) Obtain the Solidity value for each particle designated in 7).

9) Perform the measurement on 100 observed images and calculate the arithmetic average of the obtained Solidity and use this for the solidity.

Method for Measuring the Weight-Average Particle Diameter (D4) of the Toner

Using a "Coulter Counter Multisizer 3" (registered trademark, Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (Beckman Coulter, Inc.), for setting the measurement conditions and analyzing the measurement data, the weight-average particle diameter (D4) of the toner was determined by performing the measurement in 25,000 channels for the number of effective measurement channels and analyzing the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOMME)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations/second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) 3.3 L of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

The use of silica for the external additive A is preferred because this supports the suppression of fogging and makes it possible to obtain a stable flowability and charging performance. That is, the external additive A is preferably a silica fine particle that has a charge control agent (surface-treatment agent) on the surface thereof. While there are wet silicas, e.g., provided by the precipitation method, sol-gel method, and so forth, and dry silicas, e.g., provided by the deflagration method, fume method, and so forth, dry silicas are more preferred for the ease of control of the depressed portion-rich shape that is a characteristic feature of the present invention.

The starting material for dry silica is preferably, for example, a silicon halide compound.

Silicon tetrachloride is preferably used for the silicon halide compound; however, a silane, e.g., methyltrichlorosilane, and trichlorosilane, can be used by itself as the starting material or a mixture of a silane with silicon tetrachloride can also be used as the starting material.

The target silica can be obtained by vaporizing the starting material followed by reaction with the water produced as an intermediate in the oxyhydrogen flame, i.e., a flame hydrolysis reaction.

For example, a pyrolytic oxidation reaction of silicon tetrachloride gas in oxygen and hydrogen is utilized in accordance with the following reaction equation.

$$SiCl_4+2H_2+O_2 \rightarrow SiO_2+4HCl$$

A method for producing a nonspherical dry silica is described in the following.

Oxygen gas is supplied to a burner and the ignition burner is ignited; hydrogen gas is then supplied to the burner and a flame is formed; and the silicon tetrachloride starting material is introduced to this and is gasified. The flame hydrolysis reaction is carried out and the produced silica powder is recovered.

With regard to the average particle diameter and shape, the shape of the depressed portion-rich external additive can be freely adjusted by appropriate changes in the silicon tetrachloride flow rate, the oxygen gas supply flow rate, the hydrogen gas supply flow rate, and the residence time of the silica in the flame.

As a means for controlling the depressed portion-rich shape, the obtained silica powder may be transferred to an electric furnace and spread into a thin layer configuration and a heat treatment may then be executed to bring about sintering. By inducing sintering, the coalescence strength of the external additive is increased and the inhibitory effect on drum scratching at the cleaning section is readily improved further, and this is thus preferred.

As long as the desired properties are obtained, there are no particular limitations on the content of the external additive A. At least 0.1 mass parts and not more than 10.0 mass parts per 100 mass parts of the toner particle is preferred.

A charge control agent is present on the surface of the external additive A. Such an external additive A can be obtained, for example, by treating the surface thereof with a charge control agent (surface-treatment agent). The method for treating the external additive surface with the charge control agent (surface-treatment agent) can be exemplified by a method in which the charge control agent is dissolved in water or an organic solvent, the solution is added—by dripping or spraying—to the external additive and mixing is carried out, and the water or organic solvent is subsequently removed by a heat treatment. This can yield the charge control agent (surface-treatment agent)-bearing external additive A.

A deagglomerator, for example, an Atomizer (Tokyo Atomizer), can be used as the method for deagglomerating the external additive A. The solidity of the external additive A can be controlled by free adjustment of the rotation rate of the deagglomerator and the feed rate to the deagglomerator.

In addition, with regard to charge control agents that are poorly soluble in solvent and when surface treatment cannot be carried out with the charge control agent alone, a solution may be produced using a solvent-soluble resin, the charge control agent may be mixed into this solution, and treatment with the external additive may then be carried out.

The amount of charge control agent (surface-treatment agent) present at the surface of the external additive A used in the present invention, expressed with reference to the mass of the external additive A, is preferably at least 1 mass % and not more than 15 mass % and is more preferably at least 1 mass % and not more than 10 mass %.

The solidity and wall friction angle θ of the external additive A can be readily brought into the desired ranges by having the amount of surface treatment by the charge control agent be in the indicated range. When the amount of surface treatment is at least 1 mass %, the portion of the external additive surface not coated by the charge control agent is reduced and an excellent lubricity is obtained. When the amount of surface treatment is not more than 15 mass %, an excellent solidity can be achieved because a suitable treatment of the depressed portions of the external additive with the charge control agent can then be carried out.

Using the area of the polycarbonate thin film as 100.0 area %, the amount of attachment of the external additive A in a polycarbonate thin film attachment measurement method is preferably at least 0.1 area % and not more than 5.0 area % for the toner of the present invention and is more preferably at least 0.1 area % and not more than 4.0 area %.

When the amount of attachment for the external additive A is at least 0.1 area %, a favorable amount of the external additive A is fed to the cleaning section and a satisfactory lubrication effect can then be obtained and the cleaning performance becomes excellent. When the amount of attachment for the external additive A is not more than 5.0 area %, this avoids an excessive feed of the external additive A to the cleaning section and the external additive A passes through the nip section at a favorable frequency and due to this the occurrence of drum scratching is impeded.

The amount of attachment of the external additive A can be controlled by varying the strength of external addition and amount of addition.

The toner of the present invention preferably exhibits a total energy—calculated from the perpendicular load and the rotational torque when a propeller-type blade, for which the outermost edge rotates at a peripheral velocity of 100 mm/sec, is perpendicularly inserted, while rotating, into a powder layer of the toner formed by applying a load of 3.0 kPa—of at least 600 mJ and not more than 1,000 mJ. This total energy is more preferably at least 700 mJ and not more than 900 mJ.

This total energy is measured in the present invention using a powder flowability analyzer (FT4 Powder Rheometer, Malvern Instruments Ltd.) equipped with a rotary propeller-type blade.

The measurement is specifically carried out using the following procedure. A blade with a diameter of 48.0 mm provided for use in measurement with the FT4 is used in the procedure for the propeller-type blade (refer to FIGS. 1A and 1B: the rotational axis is present in the perpendicular direction in the center of a 48 mm×10 mm blade member, and the blade member is smoothly twisted counterclockwise so that both outermost edges (the locations 24 mm from the rotational axis) are at 70° and the locations at 12 mm from the rotational axis are at 35°. The material is SUS. This is also abbreviated as "blade" in the following.).

The powder layer is provided by introducing the toner, after holding for at least 3 days in a 23° C./60% humidity environment, into a cylindrical split vessel (height from the vessel bottom to the split position=43 mm. Material=glass. Also abbreviated in the following as the "vessel".) having a diameter of 50 mm and a volume of 85 mL that is an FT4 measurement accessory; the toner is introduced to the top of this vessel.

1. Conditioning Step (a) Insertion is performed from the surface of the powder layer to a position 10 mm from the bottom of the powder layer using a rotational direction that is clockwise with respect to the powder layer surface (direction whereby the powder layer is loosened by blade rotation), using a peripheral velocity at the outermost edge of the blade of 60 mm/sec for the blade rotation speed, and using, for the insertion velocity in the perpendicular direction into the powder layer, a speed that provides 5 deg for the angle formed between the surface of the powder layer and the trajectory traced by the outermost edge of the blade during motion (this is also referred to below as the "formed angle"). This is followed by the execution of a step in which insertion is carried out to a position 1 mm from the bottom of the powder layer using a clockwise rotational direction with respect to the powder layer surface, a blade rotation speed of 40 mm/sec, and a speed that provides a formed angle of 2 deg for the insertion velocity in the perpendicular direction into the powder layer. This is followed by withdrawal by movement to a position 80 mm from the bottom of the powder layer using a counterclockwise rotational direction with respect to the powder layer surface, a blade rotation speed of 60 mm/sec, and a withdrawal speed from the powder layer that provides a formed angle of 5 deg. Once the withdrawal is complete, the powder sticking to the blade is knocked off by small rotations of the blade back and forth between clockwise and counterclockwise.

2. Powder Layer Consolidation Step

To compress the powder layer, a compression test piston (diameter=48.0 mm, height=20 mm, with lower mesh) is used instead of the propeller-type blade described above, and a load of 5.0 kPa is applied and consolidation is carried out in this state for 60 seconds.

3. Splitting Step

The powder layer is leveled at the splitting position of the vessel provided as described above as an accessory for measurement with the FT4, and the powder in the upper powder layer is removed to form a powder layer with a height of 43 mm from the bottom of the vessel to the split position.

4. Measurement Step (a) The blade is rotated at a peripheral velocity (peripheral velocity of the outermost edge of the blade) of 100 mm/sec in a rotation direction that is counterclockwise with respect to the surface of the toner powder layer (direction whereby the powder layer is pressed into by the rotation of the blade). The propeller-type blade is inserted to a position 10 mm from the bottom of the toner powder layer using, for the insertion velocity in the perpendicular direction into the toner powder layer, a speed that provides 5 (deg) for the angle formed between the surface of the powder layer and the trajectory traced by the outermost edge of the blade during motion (this is also referred to below as the "blade trajectory angle"). This is followed by the insertion of the blade to a position 1 mm from the bottom of the toner powder layer by rotation clockwise with respect to the powder layer surface (direction whereby the powder layer is loosened by blade rotation) at a blade peripheral velocity of 60 mm/sec and a speed that provides a blade trajectory angle of 2 (deg). In addition, withdrawal is carried out by movement of the blade to a position 100 mm from the bottom of the powder layer at a speed that provides a blade trajectory angle of 5 (deg). Once the withdrawal is complete, the toner sticking to the blade is knocked off by small rotations of the blade back and forth between clockwise and counterclockwise.

(b) The procedure in (a) is carried out 4 times.

The value measured at the 4th execution of (b) is used as the total energy for the toner.

This total energy indicates the ease of loosening within the toner in a consolidated toner powder layer, and an excellent toner flowability can be obtained by having the total energy be in the indicated range. In addition, the present inventors believe that, by having the total energy be in the indicated range, toner contact with the photosensitive drum surface is also facilitated and as a consequence the external additive A is easily transferred and can be efficiently supplied to the cleaning section.

The toner of the present invention preferably also has an external additive B as a second external additive. From the standpoint of toner flowability, this external additive B is preferably a hydrophobically treated external additive of silica fine particles or titania fine particles. The number-average particle diameter of primary particles is preferably at least 5 nm and not more than 30 nm and is more preferably at least 5 nm and not more than 20 nm. The method for executing the hydrophobic treatment can be exemplified by methods in which treatment is carried out using an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these or a mixture of two or more may be used.

The silicone oil can be exemplified by dimethylsilicone oil, methylphenylsilicone oil, α-methylstyrene-modified silicone oil, chlorophenylsilicone oil, and fluorine-modified silicone oil.

Commercial silicas can be purchased under the product names of, for example, AEROSIL (Nippon Aerosil Co., Ltd.) 130, 200, 300, 380, MOX170, MOX80, and COK84; Ca-O-Sil (Cabot Corporation) M-5, MS-7, MS-75, HS-5, and EH-5; Wacker HDK N20 (Wacker-Chemie GmbH) V15, N20E, T30, and T40; D-C Fine Silica (Dow Corning Corporation); and Fransol (Fransil Co.), and these may also be advantageously used by the present invention.

The relationship in the following formula (5) is preferably satisfied where a (nm) is the number-average particle diameter (D1) of primary particles of the external additive A and b (nm) is the number-average particle diameter (D1) of primary particles of the external additive B.

$$5.0 \leq a/b \leq 50.0 \qquad \text{formula (5)}$$

When the ratio (a/b) between the number-average particle diameter (D1) of primary particles of the external additive A and the external additive B is at least 5.0, the opportunity for contact between the external additive A and the surface of the photosensitive drum is increased and a satisfactory transfer of the external additive A to the surface of the photosensitive drum can then be brought about. When this is not more than 50.0, the toner flowability and the charging performance are improved and as a result image streaks and fogging can be suppressed. a/b is more preferably at least 5.0 and not more than 40.0.

There are no particular limitations on the toner particle production method. Examples thereof are methods that directly produce toner in a hydrophilic medium, such as suspension polymerization, interfacial polymerization, and dispersion polymerization (also referred to below as polymerization methods). In addition, the pulverization method be used, and the toner yielded by the pulverization method may be subjected to heat sphericizing.

Among these, toner produced by suspension polymerization is preferred because the individual particles are then uniformly approximately spherical and the charge quantity distribution is also relatively uniform and due to this the toner has a high transferability.

Suspension polymerization is a method in which a toner particle is produced via a granulation step, in which a polymerizable monomer composition containing the polymerizable monomer that forms the binder resin, colorant, and optional additives such as wax, is dispersed in an aqueous medium to produce droplets of the polymerizable monomer composition; and a polymerization step in which the polymerizable monomer in the droplets is polymerized.

The toner of the present invention is preferably a toner having a toner particle that has at least a core and a shell on the surface of the core. The presence of such a structure makes it possible to prevent the blocking and faulty charging caused by exudation of the core to the toner particle surface.

In addition, more preferably a surface layer having a resin composition different from that of the shell is present on the surface of the shell. The presence of this surface layer can bring about additional improvements in the environmental stability, durability, and blocking resistance.

Vinylic polymerizable monomer is a preferred example of polymerizable monomer that can be used to produce the toner particle.

Examples here are styrene; styrene derivatives such as α-methylstyrene, β-methylstyrene, o-methylstyrene, m-methylstyrene, p-methylstyrene, and 2,4-dimethylstyrene; acrylic polymerizable monomers such as methyl acrylate, ethyl acrylate, n-propyl acrylate, isopropyl acrylate, n-butyl acrylate, isobutyl acrylate, tert-butyl acrylate, and 2-ethylhexyl acrylate; methacrylic polymerizable monomers such as methyl methacrylate, ethyl methacrylate, n-propyl methacrylate, isopropyl methacrylate, n-butyl methacrylate, isobutyl methacrylate, and tert-butyl methacrylate; esters of methylene aliphatic monocarboxylic acids; and vinyl esters such as vinyl acetate, vinyl propionate, vinyl butyrate, vinyl benzoate, and vinyl formate.

The shell is preferably formed by a resin such as a polyester, a styrene-acrylic copolymer, or a styrene-methacrylic copolymer.

The toner particle preferably contains a wax.

The wax component can be exemplified by petroleum waxes such as paraffin waxes, microcrystalline waxes, and petrolatum, and derivatives thereof; montan wax and derivatives thereof; hydrocarbon waxes provided by the Fischer-Tropsch method, and derivatives thereof; polyolefin waxes such as polyethylene and polypropylene, and derivatives thereof; and natural waxes such as carnauba wax and candelilla wax, and derivatives thereof, wherein the derivatives include oxides, block copolymers with vinylic monomer, and graft modifications. Also usable are higher aliphatic alcohols, fatty acids such as stearic acid and palmitic acid, compounds thereof, acid amide waxes, and ester waxes.

The toner particle contains a colorant.

The following are used as black colorants: carbon black, magnetic bodies, and black colorants provided by color mixing using the yellow/magenta/cyan colorants described below to give a black color.

Yellow colorants can be exemplified by compounds as represented by condensed azo compounds, isoindolinone compounds, anthraquinone compounds, azo metal complexes, methine compounds, and allylamide compounds. Specific examples are as follows: C. I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples are as follows: C. I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269 and C. I. Pigment Violet 19.

Cyan colorants can be exemplified by copper phthalocyanine compounds and their derivatives, anthraquinone compounds, and basic dye lake compounds. Specific examples are C. I. Pigment Blue 1, 7, 15, 15:1, 15:2, 15:3, 15:4, 60, 62, and 66.

A single one of these colorants or a mixture thereof may be used, and they may also be used in the form of a solid solution. The colorant is selected considering the hue angle, chroma, lightness, lightfastness, OHP transparency, and dispersibility in the toner. The amount of colorant addition is preferably at least 1 mass parts and not more than 20 mass parts per 100 mass parts of the binder resin or polymerizable monomer that produces the binder resin.

The toner of the present invention may also be executed as a magnetic toner by incorporating a magnetic body as a colorant. This magnetic body can be exemplified by iron oxides such as magnetite, hematite, and ferrite; metals such as iron, cobalt, and nickel; and alloys and mixtures of these metals with metals such as aluminum, copper, magnesium, tin, zinc, beryllium, calcium, manganese, selenium, titanium, tungsten, and vanadium.

This magnetic body is more preferably a surface-modified magnetic body. When a magnetic toner is prepared by a polymerization method, the magnetic body preferably has a hydrophobic treatment executed thereon using a surface modifier that is a substance that does not inhibit the polymerization. This surface modifier can be exemplified by silane coupling agents and titanium coupling agents. The magnetic body preferably has a number-average particle diameter of not more than 2.0 μm and more preferably at least 0.1 μm and not more than 0.5 μm. The amount incorporated in the toner particle, per 100 mass parts of the polymerizable monomer or binder resin, is preferably at least 20 mass parts and not more than 200 mass parts and more preferably at least 40 mass parts and not more than 150 mass parts.

The average circularity of the toner particle is preferably at least 0.960. The fine line reproducibility is also improved at 0.960 and above. The average circularity of the toner is preferably at least 0.970.

The effects of the present invention are more readily exhibited when the content of toner with a circularity of at least 0.990 (true sphere content) is at least 10%. The true sphere content is the content of circularities of at least 0.990 in the toner. The fine line reproducibility is further improved as the true sphere content increases.

An example of a production method for producing the toner particle by the pulverization method is provided in the following. In a starting material mixing step, the binder resin, colorant, and optional other additives, i.e., the materials constituting the toner particle, are metered out in prescribed amounts and are blended and mixed. The mixing apparatus can be exemplified by double cone mixers, V-mixers, drum mixers, the Supermixer, the FM mixer, the Nauta mixer, and the Mechano Hybrid (Nippon Coke & Engineering. Co., Ltd.).

The mixed starting materials are then melt-kneaded to disperse the colorant and so forth in the binder resin. A batch kneader, e.g., a pressure kneader or Banbury mixer, or a continuous kneader can be used in the melt-kneading step. Single-screw and twin-screw extruders have become the main stream here because they offer the advantage of enabling continuous production. Examples here are the Model KTK twin-screw extruder (Kobe Steel, Ltd.), Model TEM twin-screw extruder (Toshiba Machine Co., Ltd.), PCM kneader (Ikegai Corp), Twin Screw Extruder (KCK), Co-Kneader (Buss AG), and Kneadex (Nippon Coke & Engineering. Co., Ltd.). The resin composition obtained by melt-kneading may additionally be rolled out using, for example, a two-roll mill, and may be cooled in a cooling step, for example, with water.

The cooled resin composition is then pulverized to the desired particle diameter in a pulverization step. In the pulverization step, a coarse pulverization is performed using a grinder such as a crusher, hammer mill, or feather mill, followed by a fine pulverization using a fine pulverizer such as a Kryptron System (Kawasaki Heavy Industries, Ltd.), Super Rotor (Nisshin Engineering Inc.), or Turbo Mill (Freund-Turbo Corporation) or using an air jet system.

Toner particles are then obtained as necessary by carrying out classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

The toner particle may be spheronized. After pulverization, a spheronizing treatment may be carried out using, for example, a Hybridization System (Nara Machinery Co., Ltd.), Mechanofusion System (Hosokawa Micron Corporation), Faculty (Hosokawa Micron Corporation), or Meteo Rainbow MR Type (Nippon Pneumatic Mfg. Co., Ltd.).

The toner can be obtained by mixing the external additive A with the toner particle that contains at least a binder resin and colorant. The mixing apparatus for externally adding the external additive to the toner particle can be exemplified by the FM mixer (Nippon Coke & Engineering. Co., Ltd.), Supermixer (Kawata Mfg. Co., Ltd.), Nobilta (Hosokawa Micron Corporation), and Hybridizer (Nara Machinery Co., Ltd.).

The sieving apparatus used to sieve out coarse particles after external addition can be exemplified by the following: Ultrasonic (Koei Sangyo Co., Ltd.), Rezona Sieve and Gyro-Sifter (Tokuju Co., Ltd.), Vibrasonic System (Dalton Corporation), Soniclean (Sintokogio, Ltd.), Turbo Screener (Freund-Turbo Corporation), and Microsifter (Makino Mfg. Co., Ltd.).

<Measurement of the Molecular Weight Distribution>

The molecular weight and molecular weight distribution of the charge control agent are determined as polystyrene by gel permeation chromatography (GPC). In the case of a sulfonic acid-containing charge control agent, the column elution rate also depends on the amount of the sulfonic acid group, and due to this an accurate molecular weight and molecular weight distribution are not measured. As a result, a sample must be prepared in which the sulfonic acid group has been capped in advance. Methyl esterification is preferred for capping, and a commercial methyl esterifying agent can be used. A method that carries out treatment with trimethylsilyldiazomethane is a specific example.

Molecular weight measurement using GPC is carried out proceeding as follows. A solution is prepared by adding the charge control agent to tetrahydrofuran (THF) and allowing to stand for 24 hours at room temperature. This solution is filtered across a "Sample Pretreatment Cartridge" solvent-resistant membrane filter with a pore diameter of 0.2 μm (from the Tosoh Corporation) to obtain the sample solution. The measurement is performed under the conditions given below. During sample preparation, the amount of THF is adjusted so as to provide a resin concentration of 0.8 mass %. When the resin is poorly soluble in THF, a basic solvent such as DMF may be used.

instrument: HLC8120 GPC (detector: RI) (Tosoh Corporation)

columns: 7-column train of Shodex KF-801, 802, 803, 804, 805, 806, and 807 (Showa Denko K.K.)

eluent: tetrahydrofuran (THF)

flow rate: 1.0 mL/min oven temperature: 40.0° C.

sample injection amount: 0.10 mL

A molecular weight calibration curve constructed using the standard polystyrene resin columns listed hereafter is used to determine the molecular weight of the sample. This is specifically the products "TSK Standard Polystyrene F-850, F-450, F-288, F-128, F-80, F-40, F-20, F-10, F-4, F-2, F-1, A-5000, A-2500, A-1000, and A-500" from the Tosoh Corporation.

<Measurement of the Acid Value>

The acid value is the number of milligrams of potassium hydroxide required to neutralize the acid present in 1 g of a sample. The acid value of the binder resin and charge control agent (charge control resin) is measured in accordance with JIS K 0070-1992, and in specific terms the measurement is carried out according to the following procedure.

(1) Reagent Preparation

A phenolphthalein solution is obtained by dissolving 1.0 g of phenolphthalein in 90 mL of ethyl alcohol (95 vol %) and bringing to 100 mL by adding deionized water.

7 g of special-grade potassium hydroxide is dissolved in 5 mL of water and this is brought to 1 L by the addition of ethyl alcohol (95 vol %). This is introduced into an alkali-resistant container avoiding contact with, for example, carbon dioxide, and allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of the sample is exactly weighed into a 200-mL Erlenmeyer flask and 100 mL of a toluene/ethanol (2:1) mixed solution is added and dissolution is carried out over 5 hours. Several drops of the aforementioned phenolphthalein solution are added as indicator and titration is performed using the aforementioned potassium hydroxide solution. The titration endpoint is taken to be persistence of the faint pink color of the indicator for approximately 30 seconds.

(B) Blank Test

The same titration as in the above procedure is run, but without using the sample (that is, with only the toluene/ethanol (2:1) mixed solution).

(3) The acid value is calculated by substituting the obtained results into the following formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: sample (g).

<Method for Measuring the Average Circularity>

The average circularity of the toner is measured using an "FPIA-3000" (Sysmex Corporation), a flow particle image analyzer, and using the measurement and analysis conditions from the calibration process.

The specific measurement method is as follows. First, approximately 20 mL of deionized water from which solid impurities and so forth have been preliminarily removed, is introduced into a glass container. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.). Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be at least 10° C. and not more than 40° C. Using a benchtop ultrasound cleaner/disperser that has an oscillation frequency of 50 kHz and an electrical output of 150 W (for example, the "VS-150" (Velvo-Clear)) as the ultrasound disperser, a prescribed amount of deionized water is introduced into the water tank and approximately 2 mL of Contaminon N is added to the water tank.

The previously indicated flow particle image analyzer fitted with a "UPlanApro" objective lens (10×, numerical aperture: 0.40) is used for the measurement, and "PSE-900A" (Sysmex Corporation) particle sheath is used for the sheath solution. The dispersion prepared according to the procedure described above is introduced into the flow particle image analyzer and 3,000 of the toner particles are measured according to total count mode in HPF measurement mode. The average circularity of the toner particles is determined with the binarization threshold value during particle analysis set at 85% and the analyzed particle diameter limited to a circle-equivalent diameter of at least 1.985 μm and less than 39.69 μm. For this measurement, automatic focal point adjustment is performed prior to the start of the measurement using reference latex particles (for example, a dilution with deionized water of "RESEARCH AND TEST PARTICLES Latex Microsphere Suspensions 5200A", Duke Scientific Corporation). After this, focal point adjustment is preferably performed every two hours after the start of measurement.

In the examples in this application, the flow particle image analyzer used had been calibrated by the Sysmex Corporation and had been issued a calibration certificate by the Sysmex Corporation. The measurements were carried out under the same measurement and analysis conditions as when the calibration certification was received, with the exception that the analyzed particle diameter was limited to a circle-equivalent diameter of at least 1.985 μm and less than 39.69 μm.

EXAMPLES

The present invention is specifically described based on the following examples. However, the embodiments of the present invention are in no way limited thereto or thereby. Unless specifically indicated otherwise, the parts and % in the examples are on a mass basis.

Charge Control Agent Production Examples CCA1 Production Example 1,000 parts of pure water and 4 parts of sodium dodecyl sulfate as emulsifying agent were introduced into a 3-L flask fitted with a stirrer, condenser, thermometer, and nitrogen introduction line and nitrogen substitution was carried out for 30 minutes. 2 parts of potassium peroxodisulfate (KPS) was introduced with stirring and dissolution. The contents were heated to 80° C. while introducing nitrogen. Once 80° C. was reached, a monomer mixture of 300 parts of styrene and 60 parts of 2-ethylhexyl acrylate (2-EHA) and an aqueous solution of 40 parts of 2-acrylamido-2-methylpropanesulfonic acid (AMPS) dissolved in 600 parts of pure water were gradually added dropwise over 2 hours. After this, a polymerization was run for 8 hours as is at 80° C. to obtain an emulsion solution. This emulsion solution was dried using a vacuum drier at 50° C. until the water fraction was not more than 1% to obtain CCA1, which was a styrene/2-EHA/AMPS copolymer. The properties of this CCA1 are given in Table 1.

CCA2 Production Example 18 parts of 2,4-dihydroxybenzoic acid was dissolved in 150 parts of methanol; 36.9 parts of potassium carbonate was added; and heating to 65° C. was carried out. To this reaction solution was added dropwise a mixture of 18.7 parts of 4-(chloromethyl)styrene and 100 parts of methanol, and a reaction was run for 3 hours at 65° C. The reaction solution was then cooled and subsequently filtered and the filtrate was concentrated to obtain a crude product. The crude product was dispersed in 1,500 parts of water residing at pH 2, and precipitation was induced by the addition of ethyl acetate. This was followed by washing with water, drying over magnesium sulfate, and removal of the ethyl acetate under reduced pressure to obtain the precipitate. The precipitate was purified by washing with hexane and recrystallization from toluene and ethyl acetate to obtain the vinyl monomer given by the following formula (6).

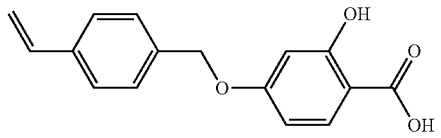

(6)

13.1 parts of the vinyl monomer with formula (6) and 81.9 parts of styrene were then dissolved in 42.0 parts of toluene; stirring was performed for 1 hour; and heating was subsequently carried out to 110° C. To this reaction solution was added dropwise a mixture of 3.0 parts of tert-butyl peroxyisopropyl monocarbonate (product name: Perbutyl I, NOF Corporation) and 42 parts of toluene. A reaction was run for 4 hours at 110° C. This was followed by cooling and the dropwise addition of 1,000 parts of methanol to obtain a precipitate. The obtained precipitate was dissolved in 120 parts of THF, followed by the dropwise addition of 1,800 parts of methanol to precipitate a white precipitate, filtration, and drying under reduced pressure at 90° C. to obtain CCA2, which was a copolymer of styrene and the vinyl monomer with formula (6). The properties of this CCA2 are given in Table 1.

CCA3 to CCA6 Production Example

CCA3 to CCA6 were each produced by changing, as shown in Table 2, the amount of monomer used (parts) in the CCA1 Production Example and while controlling the molecular weight using the polymerization temperature and/or the polymerization time. The properties of CCA3 to CCA6 are given in Table 1.

CCA7

T-77 (Hodogaya Chemical Co., Ltd.) was used.

TABLE 1

Properties of the charge control agents CCA

| | CCA1 | CCA2 | CCA3 | CCA4 | CCA5 | CCA6 |
|---|---|---|---|---|---|---|
| Functional group | Sulfonic acid | Salicyic acid | Sulfonic acid | Sulfonic acid | Sulfonic acid | Sulfonic acid |
| Acid value | 21.6 | 27.2 | 16.5 | 12.8 | 32.8 | 38.1 |
| Mw | 18300 | 29800 | 26400 | 31600 | 27900 | 24200 |

TABLE 2

Monomer composition of the CCA's

| | CCA1 | CCA3 | CCA4 | CCA5 | CCA6 |
|---|---|---|---|---|---|
| Styrene | 300 | 300 | 300 | 300 | 300 |
| 2-EHA | 60 | 60 | 60 | 60 | 60 |
| AMPS | 40 | 34 | 29 | 52 | 59 |

oxygen gas flow rate, hydrogen gas flow rate, silica concentration, residence time, and sintering conditions.

The properties of external additive base materials 2 to 7 and 9 are given in Table 3.

External Additive Base Material 8

Alumina particles having a number-average particle diameter (D1) of primary particles of 79 nm were prepared.

External Additive Base Material 10

SO-E5 silicon oxide fine particles (particle shape: spherical, Admatechs Company Limited) were used.

External Additive Base Material 11

Sol-gel silica particles having a number-average particle diameter (D1) of primary particles of 120 nm were prepared.

TABLE 3

Properties of the external additive base materials

| | 1 | 2 | 3 | 4 | 5 | 6 | 7 | 8 | 9 | 10 | 11 |
|---|---|---|---|---|---|---|---|---|---|---|---|
| Base material composition | Silica | Silica | Silica | Silica | Silica | Silica | Silica | Alumina | Silica | Silica | Silica |
| D1 (nm) | 246 | 136 | 81 | 384 | 462 | 81 | 462 | 79 | 51 | 580 | 120 |
| Solidity of the base material | 0.77 | 0.73 | 0.71 | 0.84 | 0.86 | 0.84 | 0.89 | 0.84 | 0.68 | 0.94 | 0.95 |

External Additive Base Material Production Examples

External Additive Base Material 1 Production Example

Silica fine particles were obtained by supplying oxygen gas to a burner and igniting the ignition burner; then supplying hydrogen gas to the burner and forming a flame; and introducing the starting silicon tetrachloride to this and bringing about its gasification. Specifically, the silicon tetrachloride gas starting material flow rate was 130 kg/hr; the hydrogen gas flow rate was 50 $Nm^3$/hr and the oxygen gas flow rate was 25 $Nm^3$/hr; the silica concentration in the flame was 0.50 kg/$Nm^3$; and the residence time was 0.020 seconds. The obtained silica fine particles were transferred to an electric furnace and spread into a thin layer configuration and a heat treatment was then executed at 900° C. to bring about sintering and aggregation, thereby yielding the external additive base material 1.

The properties of the external additive base material 1 are given in Table 3.

External Additive Base Materials 2 to 7 and 9 Production Example

External additive base materials 2 to 7 and 9 were obtained by adjusting the silicon tetrachloride flow rate, External Additive A Production Examples External Additive A-1 Production Example A solution of 5 g of charge control agent CCA1 dissolved in toluene was sprayed on 100 g of external additive base material 1 and immobilization of the CCA1 was carried out by stirring and mixing for 2 hours. This was followed by a heat treatment at 200° C. to evaporate the toluene and yield an external additive base material 1/CCA1 composite having CCA1 at the surface. The shape was then controlled by deagglomerating the obtained external additive base material 1/CCA1 composite with a TAP-1W Atomizer (Tokyo Atomizer) pulverizer, thus obtaining an external additive A-1 in which the surface of the external additive base material 1 was treated with CCA1. The rotation rate for the deagglomerator was 4,000 rpm, and the feed rate to the deagglomerator was 5 kg/h. The properties of the obtained external additive A-1 are given in Table 4.

External Additives A-2 to A-13, A-15 to A-20, and A-22 Production Example

External additives A-2 to A-13, A-15 to A-20, and A-22 were obtained proceeding as in the External Additive A-1 Production Example, but changing the external additive base material+charge control agent combination and the deagglomeration conditions as shown in Table 4. The properties are given in Table 4.

External Additive A-14 Production Example 5 g of a polyester resin (terephthalic acid-propylene oxide-modified bisphenol A (2 mole adduct) copolymer (molar ratio=51:50), acid value: 10 mg KOH/g, glass transition temperature: 70° C., Mw: 10,500, Mw/Mn: 3.2) was dissolved in toluene and 5 g of CCA7 was additionally mixed to obtain a dispersion solution of CCA7. The obtained dispersion solution was sprayed on 100 g of external additive base material 1 and immobilization of the CCA7 was carried out by stirring and mixing for 2 hours. This was followed by a heat treatment at 200° C. to evaporate the toluene and yield an external additive base material 1/CCA7 composite having CCA7 at the surface. An external additive A-14, in which the surface of the external additive base material 1 was treated with CCA7, was obtained by changing the deagglomeration step to the conditions shown in Table 4. The properties of the obtained external additive A-14 are given in Table 4.

External Additive A-21 Production Example

By using a jet mill (type IDS-2, Nippon Pneumatic Mfg. Co., Ltd.) as the deagglomerator, External additives A-21 was obtained using the same material as in the External Additive A-1 Production Example. The pulverization pressure of the jet mill was 0.4 MPa, and the feed rate to the jet mill was 1 kg/h.

External Additive B

The external additives described in Table 5 below were prepared as external additive B.

TABLE 5

Properties of external additive B

| External additive No. | D1 (nm) | Surface treatment |
|---|---|---|
| B-1 | 10 | Hexamethyldisilazane |
| B-2 | 7 | Hexamethyldisilazane |
| B-3 | 15 | Hexamethyldisilazane |

Toner Particle Production Example 710 parts of deionized water and 850 parts of a 0.1 mole/liter aqueous solution of $Na_3PO_4$ were added to a four-neck vessel and were held at 60° C. while stirring at 12,000 rpm using a T. K. Homomixer high-speed stirrer (Tokushu Kika Kogyo Co., Ltd.). To this was gradually added 68 parts of a 1.0 mole/liter aqueous solution of $CaCl_2$ to prepare an aqueous dispersion medium containing microfine calcium phosphate.

| | |
|---|---|
| styrene | 124 parts |
| n-butyl acrylate | 36 parts |
| copper phthalocyanine pigment (Pigment Blue 15:3) | 13 parts |
| polyester resin (terephthalic acid-propylene oxide-modified bisphenol A (2 mole adduct) copolymer (molar ratio = 51:50), acid value: 10 mg KOH/g, glass transition temperature: 70° C., Mw: 10,500, Mw/Mn: 3.2) | 10 parts |
| negative-charging charge control agent (aluminum compound of 3,5-di-tert-butylsalicylic acid) | 0.8 parts |

TABLE 4

Production conditions and properties for external additive A

| External additive A | base material No. | Surface treatment agent | Deagglomerator rotation rate (rpm) | Feed rate to the deagglomerator (kg/h) | Properties: Surface treatment agent proportion (mass %) | Proportion of CCA (mass %) | Solidity | D1 (nm) | Wall friction angle θ |
|---|---|---|---|---|---|---|---|---|---|
| A-1 | 1 | CCA-1 | 4000 | 5 | 5 | 5 | 0.75 | 246 | 20.1 |
| A-2 | 1 | CCA-2 | 4000 | 5 | 5 | 5 | 0.77 | 246 | 21.6 |
| A-3 | 2 | CCA-1 | 4000 | 5 | 5 | 5 | 0.73 | 136 | 22.4 |
| A-4 | 3 | CCA-1 | 6000 | 5 | 5 | 5 | 0.76 | 81 | 22.8 |
| A-5 | 4 | CCA-1 | 4000 | 5 | 5 | 5 | 0.80 | 384 | 19.8 |
| A-6 | 5 | CCA-1 | 4000 | 5 | 5 | 5 | 0.81 | 462 | 19.5 |
| A-7 | 6 | CCA-1 | 6000 | 5 | 5 | 5 | 0.87 | 81 | 22.6 |
| A-8 | 7 | CCA-1 | 4000 | 5 | 5 | 5 | 0.88 | 462 | 19.5 |
| A-9 | 8 | CCA-1 | 6000 | 5 | 5 | 5 | 0.87 | 79 | 22.5 |
| A-10 | 6 | CCA-3 | 6000 | 5 | 5 | 5 | 0.85 | 81 | 22.9 |
| A-11 | 6 | CCA-4 | 6000 | 5 | 5 | 5 | 0.87 | 81 | 23.5 |
| A-12 | 6 | CCA-5 | 6000 | 5 | 5 | 5 | 0.87 | 81 | 22.6 |
| A-13 | 6 | CCA-6 | 6000 | 5 | 5 | 5 | 0.86 | 81 | 22.8 |
| A-14 | 1 | CCA-7 | 6000 | 5 | 5 | 5 | 0.77 | 246 | 21.7 |
| A-15 | 1 | Hexamethyldisilazane | — | — | 10 | — | 0.75 | 246 | 37.9 |
| A-16 | 1 | Silicone oil | — | — | 5 | — | 0.78 | 246 | 36.6 |
| A-17 | 1 | None | — | — | — | — | 0.77 | 246 | 30.8 |
| A-18 | 9 | CCA-1 | 4000 | 5 | 5 | 5 | 0.74 | 51 | 26.1 |
| A-19 | 10 | CCA-1 | 6000 | 3 | 5 | 5 | 0.93 | 580 | 19.1 |
| A-20 | 11 | CCA-1 | 6000 | 3 | 5 | 5 | 0.92 | 120 | 22.6 |
| A-21 | 1 | CCA-1 | Jet mill | — | 5 | 5 | 0.88 | 246 | 28.1 |
| A-22 | 1 | CCA-1 | 4000 | 5 | 10 | 10 | 0.79 | 246 | 20.0 |

-continued

| | |
|---|---|
| Fischer-Tropsch wax (endothermic main peak temperature: 78° C. | 15 parts |

These materials were stirred for 3 hours using an attritor (Nippon Coke & Engineering. Co., Ltd.) to prepare a monomer mixture in which the individual components were dispersed in the polymerizable monomer. 20.0 parts of the polymerization initiator 1,1,3,3-tetramethylbutyl peroxy-2-ethylhexanoate (50% toluene solution) was added to the monomer mixture to prepare a polymerizable monomer composition. The polymerizable monomer composition was introduced into the aqueous dispersion medium and granulation was carried out for 5 minutes while maintaining the rotation rate by the stirrer at 10,000 rpm. The high-speed stirrer was then changed over to a propeller stirrer; the internal temperature was raised to 70° C.; and a reaction was run for 6 hours while gently stirring.

The temperature in the container was then raised to 80° C.; holding was carried out for 4 hours; and cooling was then performed to obtain a slurry 1. Dilute hydrochloric acid was added to the container containing the slurry 1 to eliminate the dispersion stabilizer. This was followed by filtration, washing, and drying to obtain polymer particles (toner particle 1) having a weight-average particle diameter (D4) of 6.2 μm. The toner particle circularity was 0.980.

Example 1

The external additive A-1 (0.5 parts) as a first external additive and the external additive B-1 (1.0 parts) as a second external additive were added to the obtained toner particle (100 parts). These materials were mixed to effect external additive using an FM10C (Nippon Coke & Engineering. Co., Ltd.). External addition was performed using conditions of a toner particle charge amount of 1.8 kg, a rotation rate of 3,600 rpm, and an external addition time of 5 minutes. This was followed by sieving on a mesh with an aperture of 100 μm to obtain a negative triboelectric-charging toner 1. The properties of the obtained toner 1 are given in Table 6.

The following evaluations were performed using the obtained toner.

<Testing>

Considering the higher speeds and longer service lives for printers in the future, an HP Color LaserJet Enterprise M651n laser printer from HP was used that had a process speed modified to 400 mm/s. CS-680 sold by Canon Marketing Japan Inc. was used for the evaluation paper. The evaluation of the cleaning performance was carried out at a low print percentage (1%). By doing this, a small amount of the external additive A is supplied to the cleaning nip region and rigorous conditions are thus set up for the cleaning performance. In addition, the evaluation was performed in a low-temperature, low-humidity environment since the compliance with the photosensitive drum is reduced by raising the hardness of the cleaning blade. The evaluation of photosensitive member scratching was performed at a print percentage of 5% because rigorous conditions are set up when a large amount of external additive A is supplied. Fogging, image streaking, and fine line reproducibility were performed in a normal-temperature, normal-humidity environment.

<Cleaning Performance>

The cleaning capability was evaluated by carrying out a durability test in which 15,000 prints of a ruled line image having a print percentage of 1% were continuously output in a low-temperature, low-humidity environment (temperature=10° C., relative humidity=14%). Ranks A and B were regarded as passing.

A: Cleaning defects were not present on the paper even after the continuous output of 15,000 prints.

B: Vertical lines produced by toner slipping past the cleaning blade were produced on the paper in the range of a continuous output of more than 10,000 prints and fewer than 15,000 prints.

C: Vertical lines produced by toner slipping past the cleaning blade were produced on the paper in the range of a continuous output of more than 5,000 prints and not more than 10,000 prints.

D: Vertical lines produced by toner slipping past the cleaning blade were produced on the paper in the range of a continuous output of 0 to 5,000 prints.

<Photosensitive Member Scratching>

A durability test was carried out in which 3,000 prints of a ruled line image having a print percentage of 5% were continuously output in a low-temperature, low-humidity environment (temperature=10° C., relative humidity=14%), and the status of scratching on the surface of the photosensitive member was measured using a surface roughness meter. The evaluation was performed based on the ten-point average roughness Rz and the results from observation of the scratching. The Rz change ratio was calculated using the following: average roughness after the durability test/average roughness before the durability test. Ranks A and B were regarded as passing.

A: The Rz change ratio is less than 20% (no deep scratches, no influence on the image).

B: While the Rz change ratio is 20% or greater, there are no scratches equal to or greater than 1 μm (no deep scratches, no influence on the image).

C: Deep scratches of at least 1 μm and less than 2 μm are produced (slight influence on the image).

D: Deep scratches of at least 2 μm are produced (the effect of the scratches can be seen on the output image).

<Evaluation of Fogging>

The operation of outputting an image with a print percentage of 1% was repeated in a normal-temperature, normal-humidity environment (temperature of 25%, relative humidity of 60%), and standing overnight was performed each time the number of output prints reached 500. This step of outputting 500 prints and standing overnight was then repeated proceeding as described above; image output of 5,000 prints was ultimately performed; and an evaluation was performed by the following method.

In this image output test, one print of an image having a white background region was output each time after the 500 prints had been made. For all of the images having a white background region, the fogging density (%) (=Dr(%)−Ds(%)) was calculated from the difference between the whiteness (reflectance Ds(%)) of the white background region of the image having a white background region and the whiteness of transfer paper (average reflectance Dr(%)). The whiteness was measured using a "Reflectometer Model TC-6DS" (Tokyo Denshoku Co., Ltd.). An amber light filter was used for the filter. Ranking as described below was performed on the one that had the worst fogging. Ranks A and B were regarded as passing.

A: The fogging density is less than 0.4%.

B: The fogging density is at least 0.4% and less than 0.8%.

C: The fogging density is at least 0.8% and less than 1.3%.

D: The fogging density is at least 1.3%.

<White Streaks in a Full-Side Solid Image (White Streaks in a Solid Image)>

White streaks in a solid image were evaluated from the standpoint of image quality. After the 5,000 prints had been output during image output in the aforementioned evaluation of fogging, power to the image-forming apparatus was shut off and standing was carried out for 1 week. The image-forming apparatus was then restarted; one print was output of a chart on which a solid image was formed over the entire side of the printed paper; and an evaluation was conducted using the criteria given below. Ranks A and B were regarded as passing.

A: White, streak-shaped vertical lines are entirely absent from the image.

B: 1 or 2 thin white, streak-shaped vertical lines are seen in the image.

C: 1 or 2 distinct white, streak-shaped vertical lines are seen in the image.

D: 3 or more distinct white, streak-shaped vertical lines are seen in the image.

Examples 2 to 21

Toners 2 to 21 were obtained proceeding as in Example 1, but using the external addition formulations and external addition conditions described in Table 6. The properties of the toners are given in Table 6.

The results of the same evaluations as in Example 1 are given in Table 7.

Comparative Examples 1 to 7

Toners 22 to 28 were obtained proceeding as in Example 1, but using the external addition formulations and external addition conditions described in Table 6. The properties of the toners are given in Table 6.

The results of the same evaluations as in Example 1 are given in Table 7.

TABLE 6

| Properties of the toners | | | | | | | | | | |
|---|---|---|---|---|---|---|---|---|---|---|
| | External addition formulations | | | | External addition conditions | | | Toner properties | | |
| | external additive A No. | Amount of addition of external additive A (parts) | external additive B No. | Amount of addition of external additive B (parts) | Amount charged (kg) | Rotation rate (rpm) | External addition time (minutes) | Total energy | Amount of attachment | a/b |
| Toner 1 | A-1 | 0.5 | B-1 | 1.0 | 1.8 | 3600 | 5 | 817 | 2.5 | 24.6 |
| Toner 2 | A-2 | 0.5 | B-1 | 1.0 | 1.8 | 3600 | 5 | 823 | 2.6 | 24.6 |
| Toner 3 | A-3 | 0.5 | B-1 | 1.0 | 1.8 | 3600 | 5 | 797 | 1.9 | 13.6 |
| Toner 4 | A-4 | 0.5 | B-1 | 1.0 | 1.8 | 3600 | 5 | 788 | 1.4 | 8.1 |
| Toner 5 | A-5 | 0.5 | B-1 | 1.0 | 1.8 | 3600 | 5 | 831 | 3 | 38.4 |
| Toner 6 | A-6 | 0.5 | B-1 | 1.0 | 1.8 | 3600 | 5 | 842 | 3.7 | 46.2 |
| Toner 7 | A-7 | 0.5 | B-1 | 1.0 | 1.8 | 3600 | 5 | 790 | 1.5 | 8.1 |
| Toner 8 | A-8 | 0.5 | B-1 | 1.0 | 1.8 | 3600 | 5 | 839 | 3.9 | 46.2 |
| Toner 9 | A-8 | 0.6 | B-1 | 1.0 | 1.8 | 3600 | 5 | 851 | 4.7 | 46.2 |
| Toner 10 | A-8 | 0.8 | B-1 | 1.0 | 1.8 | 3600 | 5 | 846 | 5.4 | 46.2 |
| Toner 11 | A-8 | 0.8 | B-1 | 1.0 | 1.8 | 4000 | 10 | 861 | 4.1 | 46.2 |
| Toner 12 | A-7 | 0.5 | B-1 | 1.0 | 1.8 | 3200 | 3 | 798 | 3.2 | 8.1 |
| Toner 13 | A-9 | 0.5 | B-1 | 1.0 | 1.8 | 3600 | 5 | 779 | 1.6 | 7.9 |
| Toner 14 | A-10 | 0.5 | B-1 | 1.0 | 1.8 | 3600 | 5 | 795 | 1.5 | 8.1 |
| Toner 15 | A-11 | 0.5 | B-1 | 1.0 | 1.8 | 3600 | 5 | 801 | 1.6 | 8.1 |
| Toner 16 | A-12 | 0.5 | B-1 | 1.0 | 1.8 | 3600 | 5 | 795 | 1.5 | 8.1 |
| Toner 17 | A-13 | 0.5 | B-1 | 1.0 | 1.8 | 3600 | 5 | 793 | 1.7 | 8.1 |
| Toner 18 | A-8 | 0.5 | B-2 | 1.0 | 1.8 | 3600 | 5 | 810 | 3.9 | 66 |
| Toner 19 | A-7 | 0.5 | B-3 | 1.0 | 1.8 | 3600 | 5 | 861 | 0.7 | 5.4 |
| Toner 20 | A-14 | 0.5 | B-1 | 1.0 | 1.8 | 3600 | 5 | 819 | 2.5 | 24.6 |
| Toner 21 | A-22 | 0.5 | B-1 | 1.0 | 1.8 | 3600 | 5 | 820 | 2.5 | 24.6 |
| Toner 22 | A-15 | 0.5 | B-1 | 1.0 | 1.8 | 3600 | 5 | 918 | 2.5 | 24.6 |
| Toner 23 | A-16 | 0.5 | B-1 | 1.0 | 1.8 | 3600 | 5 | 946 | 2.5 | 24.6 |
| Toner 24 | A-17 | 0.5 | B-1 | 1.0 | 1.8 | 3600 | 5 | 903 | 2.6 | 24.6 |
| Toner 25 | A-18 | 0.5 | B-1 | 1.0 | 1.8 | 3600 | 5 | 769 | 0.7 | 5.1 |
| Toner 26 | A-19 | 0.5 | B-1 | 1.0 | 1.8 | 3600 | 5 | 908 | 3.9 | 58 |
| Toner 27 | A-20 | 0.5 | B-1 | 1.0 | 1.8 | 3600 | 5 | 791 | 1.7 | 12 |
| Toner 28 | A-21 | 0.5 | B-1 | 1.0 | 1.8 | 3600 | 5 | 804 | 1.9 | 24.6 |

In Table 6, "Amount of attachment" is amount of attachment in measurement of thin film attachment, and "a/b" is Number-average primary particle diameter ratio (a/b).

TABLE 7

Results of the evaluations

| Example No. | Toner No. | Cleaning performance | Photosensitive member scratching | Fogging | White streaks in a solid image |
|---|---|---|---|---|---|
| 1 | 1 | A | A (14%) | A (0.2) | A |
| 2 | 2 | A | A (14%) | A (0.2) | A |
| 3 | 3 | A | A (12%) | A (0.3) | A |
| 4 | 4 | A | A (11%) | A (0.2) | A |
| 5 | 5 | A | A (17%) | A (0.2) | A |
| 6 | 6 | A | A (18%) | A (0.3) | A |
| 7 | 7 | A | B (20%) | A (0.3) | A |
| 8 | 8 | A | B (25%) | A (0.2) | A |
| 9 | 9 | A | B (27%) | A (0.2) | A |
| 10 | 10 | A | B (32%) | A (0.3) | A |
| 11 | 11 | A | B (26%) | A (0.3) | A |
| 12 | 12 | A | B (22%) | A (0.3) | A |
| 13 | 13 | A | B (20%) | B (0.6) | A |
| 14 | 14 | A | B (20%) | A (0.3) | A |
| 15 | 15 | B (produced at 14,000 prints) | B (21%) | A (0.3) | A |
| 16 | 16 | A | B (21%) | A (0.3) | A |
| 17 | 17 | A | B (20%) | B (0.6) | A |
| 18 | 18 | A | B (26%) | B (0.5) | B (1 thin vertical line) |
| 19 | 19 | A | B (20%) | A (0.3) | A |
| 20 | 20 | A | A (14%) | A (0.2) | A |
| 21 | 21 | A | A (13%) | A (0.2) | A |
| Comparative 1 | 22 | C (drum scratching-induced, produced at 7,000 prints) | C (1.4 μm) | B (0.6) | B (2 thin vertical lines) |
| Comparative 2 | 23 | C (drum scratching-induced, produced at 7,000 prints) | C (1.4 μm) | B (0.6) | C (2 distinct vertical lines) |
| Comparative 3 | 24 | C (drum scratching-induced, produced at 9,000 prints) | C (1.2 μm) | B (0.7) | B (2 thin vertical lines) |
| Comparative 4 | 25 | D (produced at 4,000 prints) | B (25%) | A (0.2) | A |
| Comparative 5 | 26 | D (drum scratching-induced, produced at 4,000 prints) | D (2.7 μm) | B (0.7) | D (5 distinct vertical lines) |
| Comparative 6 | 27 | D (drum scratching-induced, produced at 5,000 prints) | D (2.2 μm) | A (0.3) | A |
| Comparative 7 | 28 | D (produced at 4,000 prints) | C (1.6 μm) | A (0.2) | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-178186, filed Sep. 13, 2016, which is hereby incorporated by reference herein in its entirety.

What is claimed is:

1. A toner comprising:

an external additive A having a number-average particle diameter (D1) of primary particles of 70 to 500 nm, and providing a charge control agent present on the surface thereof; and a toner particle containing a binder resin and a colorant, wherein external additive A has a wall friction angle θ calculated from formula (1) of not more than 25.0°

$$\theta=\tau/5.0 \quad (1)$$

where τ represents a shear stress obtained when a flat circular disk is rotated (π/36) rad at (π/10) rad/min while the flat circular disk is inserted at a perpendicular load of 5.0 kPa into a powder layer of external additive A formed by applying a perpendicular load of 15.0 kPa, and has a solidity of 0.40 to 0.90, where solidity=area of external additive A/convex area of external additive A.

2. The toner according to claim 1, wherein an amount of attachment of the external additive A to a polycarbonate thin film is 0.1 to 5.0 area % where an area of the polycarbonate thin film is 100.0 area %, when the polycarbonate thin film attachment measurement method comprises:

preparing a coating solution for a 50-μm aluminum sheet by dissolving 10 mass % of a polycarbonate having a viscosity-average molecular weight (Mv) of 40,000 in toluene, coating the coating solution on the aluminum sheet using a #50 Mayer bar, drying the coating solution for 10 minutes at 100° C., and producing a sheet having polycarbonate with a film thickness of 10 μm on aluminum sheet held with a substrate holder;

introducing about 10 mg of the toner onto a sieve having a stainless steel mesh with an aperture of 75 μm and a sieve opening having a diameter of 10 mm, placing a substrate directly below the sieve at a distance of 20 mm, and depositing the toner on the substrate by application, to a frame holding the sieve, of a sawtooth-waveform oscillation having a duty ratio of 33% and an amplitude of 1 mm, the oscillation being applied for 30 seconds at 5 Hz in the in-plane direction of the sieve and corresponding to an acceleration of 5 G;

promoting contact between the substrate and the toner by application, to the substrate on which the toner had been deposited, of a sawtooth-waveform oscillation having a duty ratio of 33% and an amplitude of 1 mm, the oscillation being applied for 20 seconds at 3 Hz in the in-plane direction of the substrate and corresponding to an acceleration of 0.5 G;

removing the toner attached to the substrate by bringing the substrate into proximity to an elastomeric suction port having an inner diameter of approximately 5 mm and connected to a nozzle end of a vacuum cleaner as a suction means so that the suction port becomes perpendicular to the toner-bearing side, while visually checking the degree of residual toner, distance between an end of the suction port and the substrate being approximately 1 mm, the suction time being approximately 3 seconds, and the suction pressure being 6 kPa; and quantitating an amount of attachment of the external additive supplied to the substrate.

3. The toner according to claim 1, wherein a total energy of 600 to 1,000 mJ is calculated from a perpendicular load and a rotational torque when a propeller-type blade, for which an outermost edge rotates at a peripheral velocity of 100 mm/sec, is perpendicularly inserted, while rotating, into a powder layer of the toner formed by applying a load of 3.0 kPa, the powder layer being provided by holding the toner for at least 3 days in a 23° C./60% humidity environment, and thereafter introducing it into the top of a cylindrical split glass vessel having a height from the vessel bottom to the split position of 43 mm, a diameter of 50 mm and a volume of 85 mL.

4. The toner according to claim 1, wherein the external additive A is a silica fine particle.

5. The toner according to claim 4, wherein an amount of charge control agent present on the surface of the external additive A is 1 to 15 mass % with reference to a mass of the external additive A.

6. The toner according to claim 1, wherein the charge control agent is a charge control resin, and an acid value of the charge control resin is 15 to 35 mg KOH/g.

7. The toner according to claim 6, wherein the charge control resin is selected from the group consisting of polymers having a salicylic acid-derived substructure and polymers having a sulfonic acid group.

8. The toner according to claim 6, wherein the charge control resin is selected from the group consisting of polymers having the monovalent group a given by formula (4) and resins having a substructure derived from 2-acrylamido-2-methylpropanesulfonic acid;

(4)

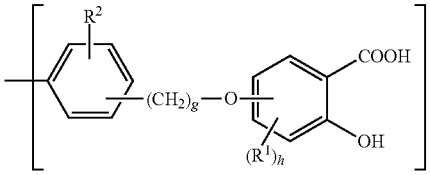

where $R^1$ independently represents a hydroxy group, a carboxy group, an alkyl group having 1 to 18 carbons, or an alkoxy group having 1 to 18 carbons; $R^2$ represents a hydrogen atom, a hydroxy group, an alkyl group having 1 to 18 carbons, or an alkoxy group having 1 to 18 carbons; g represents an integer of 1 to 3; and h represents an integer of 0 to 3.

9. The toner according to claim 1, further comprising an external additive B having a number-average particle diameter (D1) of primary particles of 5 to 30 nm, wherein $$5.0 \leq a/b \leq 50.0 \quad \text{formula (5)}$$

where a (nm) is the number-average particle diameter (D1) of primary particles of external additive A, and b (nm) is the number-average particle diameter (D1) of primary particles of external additive B.

10. A toner comprising:

an external additive A having a number-average particle diameter (D1) of primary particles of 70 to 500 nm, and providing on the surface thereof at least one compound selected from the group consisting of metal compounds of aromatic carboxylic acids, metal compounds of an azo dye or azo pigment, polymers having a sulfonic acid group or a carboxy group, quaternary ammonium salts, polymers having a quaternary ammonium salt, guanidine compounds, nigrosine compounds, and imidazole compounds; and a toner particle containing a binder resin and a colorant, wherein the external additive A has a wall friction angle θ calculated from the following formula (1) of not more than 25.0°

$$\theta = \tau/5.0 \quad \text{formula (1)}$$

where τ represents a shear stress obtained when a flat circular disk is rotated (π/36) rad at (π/10) rad/min while the flat circular disk is inserted at a perpendicular load of 5.0 kPa into a powder layer of the external additive A formed by applying a perpendicular load of 15.0 kPa, and has a solidity as given by of 0.40 to 0.90, where solidity=area of external additive A/convex region of external additive A.

11. The toner according to claim 10, wherein the compound is at least one member selected from the group consisting of monoazo metal compounds and polymers having a sulfonic acid group or a carboxy group.

12. A method of producing a toner, comprising the steps of:

obtaining an external additive A by subjecting an external additive to a surface treatment with a charge control agent, external additive A having a number-average particle diameter (D1) of primary particles of 70 to 500 nm; and mixing the external additive A with a toner particle containing a binder resin and a colorant, wherein external additive A has a wall friction angle θ calculated from formula (1) of not more than 25.0°

$$\theta = \tau/5.0 \quad \text{formula (1)}$$

where τ represents a shear stress obtained when a flat circular disk is rotated (π/36) rad at (π/10) rad/min while the flat circular disk is inserted at a perpendicular load of 5.0 kPa into a powder layer of external additive A formed by applying a perpendicular load of 15.0 kPa, and external additive A has a solidity of 0.40 to 0.90, where solidity=area of external additive A/convex area of external additive A.

* * * * *